US007830342B2

(12) United States Patent
Mutsukura et al.

(10) Patent No.: US 7,830,342 B2
(45) Date of Patent: Nov. 9, 2010

(54) PIXEL CIRCUIT, IMAGE DISPLAY DEVICE AND DRIVE METHOD FOR THE SAME, AND ELECTRONIC DEVICE

(75) Inventors: Takahiko Mutsukura, Kanagawa (JP); Mitsuru Asano, Kanagawa (JP); Seiichiro Jinta, Kanagawa (JP); Masatsugu Tomida, Kanagawa (JP)

(73) Assignee: Sony Corporation, Tokyo (JP)

( * ) Notice: Subject to any disclaimer, the term of this patent is extended or adjusted under 35 U.S.C. 154(b) by 735 days.

(21) Appl. No.: 11/882,975

(22) Filed: Aug. 8, 2007

(65) Prior Publication Data

US 2008/0042945 A1 Feb. 21, 2008

(30) Foreign Application Priority Data

Aug. 15, 2006 (JP) ..... 2006-221342

(51) Int. Cl.
*G09G 3/30* (2006.01)

(52) U.S. Cl. ..... 345/77; 345/80

(58) Field of Classification Search ..... 345/77, 345/76, 80, 82; 315/169.3; 313/483
See application file for complete search history.

(56) References Cited

U.S. PATENT DOCUMENTS

| | | | | |
|---|---|---|---|---|
| 2005/0057580 | A1* | 3/2005 | Yamano et al. | 345/690 |
| 2005/0168490 | A1* | 8/2005 | Takahara | 345/690 |
| 2005/0180083 | A1* | 8/2005 | Takahara et al. | 361/152 |
| 2006/0170628 | A1 | 8/2006 | Yamashita et al. | |

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2005-345722 | 12/2005 |
| JP | 2006-098438 | 4/2006 |

OTHER PUBLICATIONS

Japanese Office Action dated Jun. 11, 2008 for corresponding Japanese Application No. 2006-221342.

* cited by examiner

*Primary Examiner*—Ricardo L Osorio
(74) *Attorney, Agent, or Firm*—Rader, Fishman & Grauer PLLC

(57) ABSTRACT

A pixel circuit is disclosed. The pixel circuit includes, at least a drive transistor; an input transistor; a first switching transistor; a second switching transistor; a retention capacity; and an electro-optic device. The retention capacity is connected, at both ends, to a gate node and a source node, respectively, of the drive transistor. The electro-optic device has rectification properties, and is determined in intensity by a value of a drive current coming from the drive transistor whose source node is connected to an anode thereof. The input transistor is connected, at one current end, to the gate node of the drive transistor, and samples a video signal to the retention capacity during a predetermined sampling period. The first switching transistor is turned on before the sampling period, and connects the gate node of the drive transistor at a predetermined reference voltage.

12 Claims, 18 Drawing Sheets

$$I_{ds} = k\mu\,(V_{gs} - V_{th})^2 = k\mu\,(V_{sig} - \Delta V)^2$$

PIXEL CIRCUIT, IMAGE DISPLAY DEVICE AND DRIVE METHOD FOR THE SAME, AND ELECTRONIC DEVICE

CROSS REFERENCES TO RELATED APPLICATIONS

The present invention contains subject matter related to Japanese Patent Application JP 2006-221342 filed in the Japanese Patent Office on Aug. 15, 2006, the entire contents of which are incorporated herein by reference.

BACKGROUND OF THE INVENTION

1. Field of the Invention

The present invention relates to a pixel circuit that exercises control over the intensity by driving, by a current, an electro-optic device provided for every pixel, an image display device in which the pixel circuit is plurally arranged in a matrix, and a drive method for the image display device. More specifically, the invention relates to an image display device of a so-called active matrix type that exercises control over the amount of current flowing to an electro-optic device, e.g., organic electroluminescent (EL) device, using an insulated gate field effect transistor (IGFET) provided to every pixel circuit, and a drive method for the image display device. The invention also relates to an electronic device equipped with such a display device.

2. Description of the Related Art

With an image display device, e.g., liquid crystal display, a plurality of liquid crystal pixels are arranged in a matrix, and the strength of transmission or reflection of an incoming light is controlled for every pixel in accordance with information about a displaying image so that the image is displayed. This is applicable also to an organic EL display or others in which pixels are electro-optic devices, such as organic EL devices, but the organic EL devices are self-light-emitting, unlike the liquid crystal pixels. Thus this allows the organic EL display to have the advantages of better image visibility compared with a liquid crystal display, requiring no backlight, higher response speed, and others. What is more, the organic EL display is of a so-called current-controlled type, i.e., the intensity level (gray scale) of light-emitting devices is controllable by the value of a current flowing therethrough, and being the so-called current-controlled type as such is the conspicuous difference from a liquid crystal display of a voltage-controlled type.

As a liquid crystal display, an organic EL display also is classified for driving under two types: direct matrix; and active matrix. An organic EL display of a direct matrix type is simple in configuration, but it has difficulty in implementing a large-sized display with high definition. The development is thus currently active for an organic EL display of the active matrix type. The active matrix type controls a current flow in light-emitting devices in every pixel circuit using active elements, i.e., generally thin-film transistors (TFTs), inside of the pixel circuits, and is described in Patent Documents to 5, i.e., JP-A-2003-255856, JP-A-2003-271095, JP-A-2004-133240, JP-A-2004-029791, and JP-A-2004-093682.

SUMMARY OF THE INVENTION

A pixel circuit of a previous type is disposed at an intersection of a scan line and a signal line. The scan line is plurally disposed in a line for supplying a control signal, and the signal line is plurally disposed in a row for supplying a video signal. The pixel circuit includes at least an input transistor, a retention capacity, a drive transistor, and a light-emitting device. The input transistor is activated in response to a control signal coming from a scan line and samples a video signal coming from a signal line. The retention capacity retains an input voltage corresponding to the sampled video signal. The drive transistor makes a supply of an output current during any predetermined light-emission period in accordance with the input voltage retained at the retention capacity. The output current generally has dependence with respect to the carrier mobility and the threshold voltage of a channel area of the drive transistor. By the output current provided from the drive transistor, the light-emitting device emits light with an intensity corresponding to the video signal.

The drive transistor receives, at a gate, the input voltage retained at the retention capacity, and makes the output current flow between a source and a drain so that the light-emitting device is activated. As a result of light emission of the light-emitting device, the intensity is generally proportionate to the current-carrying amount. The supply amount of an output current of the drive transistor is controlled by a gate voltage, i.e., input voltage written to the retention capacity. With the pixel circuit of a previous type, an input voltage for application to the gate of the drive transistor is changed in accordance with an incoming video signal so that the amount of a current is controlled for supply to the light-emitting devices.

The operation characteristics of the drive transistor are expressed by the following equation 1.

$$Ids=(1/2)\mu(W/L)Cox(Vgs-Vth)2 \quad (1)$$

In this transistor characteristics equation 1, Ids denotes a drain current flowing between a source and a drain. In the pixel circuit, the drain current is an output current for supply to light-emitting devices. In the equation, Vgs denotes a gate voltage for application to a gate with reference to the source, and in the pixel circuit, the gate voltage is the input voltage described above. In the equation, Vth denotes a threshold voltage of a transistor, and μ denotes the mobility of a semiconductor thin film configuring the channel of a transistor. Also, in the equation, W denotes a channel width, L denotes a channel length, and Cox denotes a gate capacity. As is evident from the transistor characteristics equation 1, when a thin-film transistor operates in the saturation region, if the gate voltage Vgs exceeds the threshold voltage Vth, the thin-film transistor is set to the ON state so that the drain current Ids flows. In principle, as is indicated by the above transistor characteristics equation 1, with a constant gate voltage Vgs, the drain current Ids flowing to the light-emitting devices is always the same amount. In this sense, if every pixel of a screen is provided with a video signal of one specific level, every pixel is supposed to emit light with the same intensity, and the screen is supposed to have uniformity.

In a real-world situation, however, a thin-film transistor (TFT) configured by a semiconductor thin film, such as polysilicon, varies in device characteristics. Especially, the threshold voltage Vth is not constant in value, and every pixel has its own threshold voltage. As is evident from the above transistor characteristics equation 1, even with a constant gate voltage Vgs, any variation of the threshold voltage Vth among the drive transistors causes a variation of the drain current Ids. As a result, the intensity of the pixels also is varied, thereby impairing the uniformity of the screen. In consideration thereof, a pixel circuit has been developed with the function of cancelling out any variation observed in the threshold voltage of a drive transistor, and Patent Document 3 describes such a pixel circuit.

The issue here is that, in the previous image display device with such a function of cancelling out any variation of a threshold voltage as such, i.e., a threshold voltage correction function, the pixel intensity is reduced with some operation state of the threshold voltage correction. That is, due to the threshold voltage correction operation in a pixel circuit, an input transistor that is supposed to be in the OFF state before sampling is sometimes temporarily put in the forward bias state. If this is the case, a current leak is often caused between the pixel circuit and the signal lines through the input transistor, and the current leak is a cause of the reduction of signal potential of the signal lines. When the reduced signal potential is sampled by pixels of the preceding line, the pixels of the preceding line also are reduced in intensity. This phenomenon of intensity reduction occurs one after another as the line sequential scanning proceeds, and thus there is the problem of resultantly reducing the intensity of the entire screen.

It is thus desirable to design the threshold voltage correction operation properly so as not to cause a reduction of the intensity. According to an embodiment of the present invention, there is provided a pixel circuit, including, at least: a drive transistor; an input transistor; a first switching transistor; a second switching transistor; a retention capacity; and an electro-optic device. In the pixel circuit, the retention capacity is connected, at both ends, to a gate node and a source node, respectively, of the drive transistor, the electro-optic device has rectification properties, and is determined in intensity by a value of a drive current coming from the drive transistor whose source node is connected to an anode thereof, the input transistor is connected, at one current end, to the gate node of the drive transistor, and samples a video signal to the retention capacity during a predetermined sampling period, the first switching transistor is turned on before the sampling period, and connects the gate node of the drive transistor at a predetermined reference voltage, the second switching transistor is turned on before the sampling period, and puts, on charge, the source node of the drive transistor, i.e., the anode of the electro-optic device, to be equal to or lower than a threshold voltage of the electro-optic device, and a timing setting is made to a control signal for application to gates of the first and second switching transistors in such a manner that the first switching transistor is turned on before the second switching transistor. For example, the timing setting is made to the control signal in such a manner that the second switching transistor is turned on with a lapse of a horizontal period after the first switching transistor is turned on.

According to another embodiment of the present invention, there is provided an image display device, including: a pixel array section; a scanner section; and a signal section. In the image display device, the pixel array section includes first to third scan lines disposed in a line, signal lines disposed in a row, matrix-shaped pixel circuits connected to the scan lines and the signal lines, and a plurality of power lines that supply first and second potentials needed for operation of the pixel circuits. The signal section supplies a video signal to the signal lines. The scanner section sequentially scans the pixel circuits, on a line basis, by supplying a control signal to the first to third scan lines. The pixel circuits each include an input transistor, a drive transistor, a first switching transistor, a second switching transistor, a retention capacity, and a light-emitting device. The input transistor is turned on in response to the control signal provided by the first scan line in a predetermined sampling period, and samples a signal potential of the video signal provided by the signal lines to the retention capacity. The retention capacity applies an input voltage to a gate of the drive transistor in accordance with the signal potential of the sampled video signal. The drive transistor supplies an output current corresponding to the input voltage to the light-emitting device. The light-emitting device emits a light with an intensity corresponding to the signal potential of the video signal by the output current provided by the drive transistor during a predetermined light-emission period. The first switching transistor is turned on in response to the control signal provided by the second scan line before the sampling period, and sets the gate of the drive transistor to the first potential. The second switching transistor is turned on in response to the control signal provided by the third scan line before the sampling period, and sets a source of the drive transistor to the second potential. Herein, the scanner section makes a timing setting to the control signal in such a manner that the first switching transistor is turned on before the second switching transistor.

Preferably, the scanner section makes a timing setting to the control signal in such a manner that the second switching transistor is turned on with a lapse of a horizontal period after the first switching transistor is activated. With this being the case, the scanner section includes a logic circuit for use in creating, from an output of a shift register for common use, the control signal for turning on the first switching transistor and the control signal for turning on the second switching transistor. In one embodiment of the invention, the scanner section includes: a shift register that outputs a serial signal with a phase difference of a horizontal period; a logic circuit that outputs a pair of intermediate signals of the same phase by processing the serial signal; and a delay circuit that outputs one of the intermediate signals as the control signal for use as it is to turn on the first switching transistor, and outputs the other intermediate signal as the control signal for use in turning on the second switching transistor after a delay process. In another embodiment of the invention, the scanner section includes: a shift register that outputs a serial signal with a phase difference of a horizontal period; a logic circuit that outputs a pair of intermediate signals of the same phase by processing the serial signal; and a mask circuit that outputs one of the intermediate signals as the control signal for use as it is to turn on the first switching transistor, and outputs the other intermediate signal as the control signal for use in turning on the second switching transistor after a mask process. In still another embodiment of the invention, the scanner section includes: a shift register that outputs a serial signal with a phase difference of a horizontal period; a logic circuit that outputs a pair of intermediate signals of the same phase by processing the serial signal; and a buffer circuit that outputs one of the intermediate signals as the control signal for use in turning on the first switching transistor through a lesser number of buffers, and outputs the other intermediate signal as the control signal for use in turning on the second switching transistor through a larger number of buffers.

In one embodiment of the invention, the pixel circuits each include a third switching transistor whose gate is connected to a fourth scan line, and the third switching transistor connects the drive transistor at a third potential by being turned on in response to a control signal provided by the fourth scan line before the sampling period to retain a voltage equivalent to a threshold voltage of the drive transistor at the retention capacity for correction of any influence of the threshold voltage, and connects the drive transistor at the third potential by being turned on in response to the control signal provided again by the fourth scan line during the light-emission period to flow the output current to the light-emitting device. In the drive transistor, the output current has a dependence with respect to the carrier mobility of a channel area, and the third switching transistor connects the drive transistor to the third potential by being turned on during the sampling period, extracts the output current from the drive transistor while the signal potential is being sampled, corrects the input voltage with a negative feedback to the retention capacity, and cancels out the dependence of the output current with respect to the carrier mobility.

According to embodiments of the invention, a first switching transistor is firstly turned on, and then a second switching transistor is turned on. That is, by turning on the first switching transistor first, the gate of a drive transistor is reset to a first potential. Thereafter, the second switching transistor is turned on so that the source of the drive transistor is reset to a second potential. After potential resetting as such, a third switching transistor is turned on so that the threshold voltage correction operation is executed. At the preparation stage of the threshold voltage correction operation, because the gate of the drive transistor is firstly fixed at the first potential, the input transistor is not thus put in the state of forward bias. Accordingly, there is no current leak in the input transistor, and the signal potential is not reduced on the signal lines, thereby enabling the prevention of any possible reduction of the screen intensity. If the source of the drive transistor is set at the second potential, and if the gate thereof is then set to the first potential, this may affect the potential of the gate of the drive transistor that is at a floating level at the first resetting of the source potential, and thus the potential of the gate may largely fluctuate. This fluctuation of the gate potential puts the input transistor in the forward bias state, thereby causing a current leak.

DETAILED DESCRIPTION OF THE INVENTION

Figure 1:
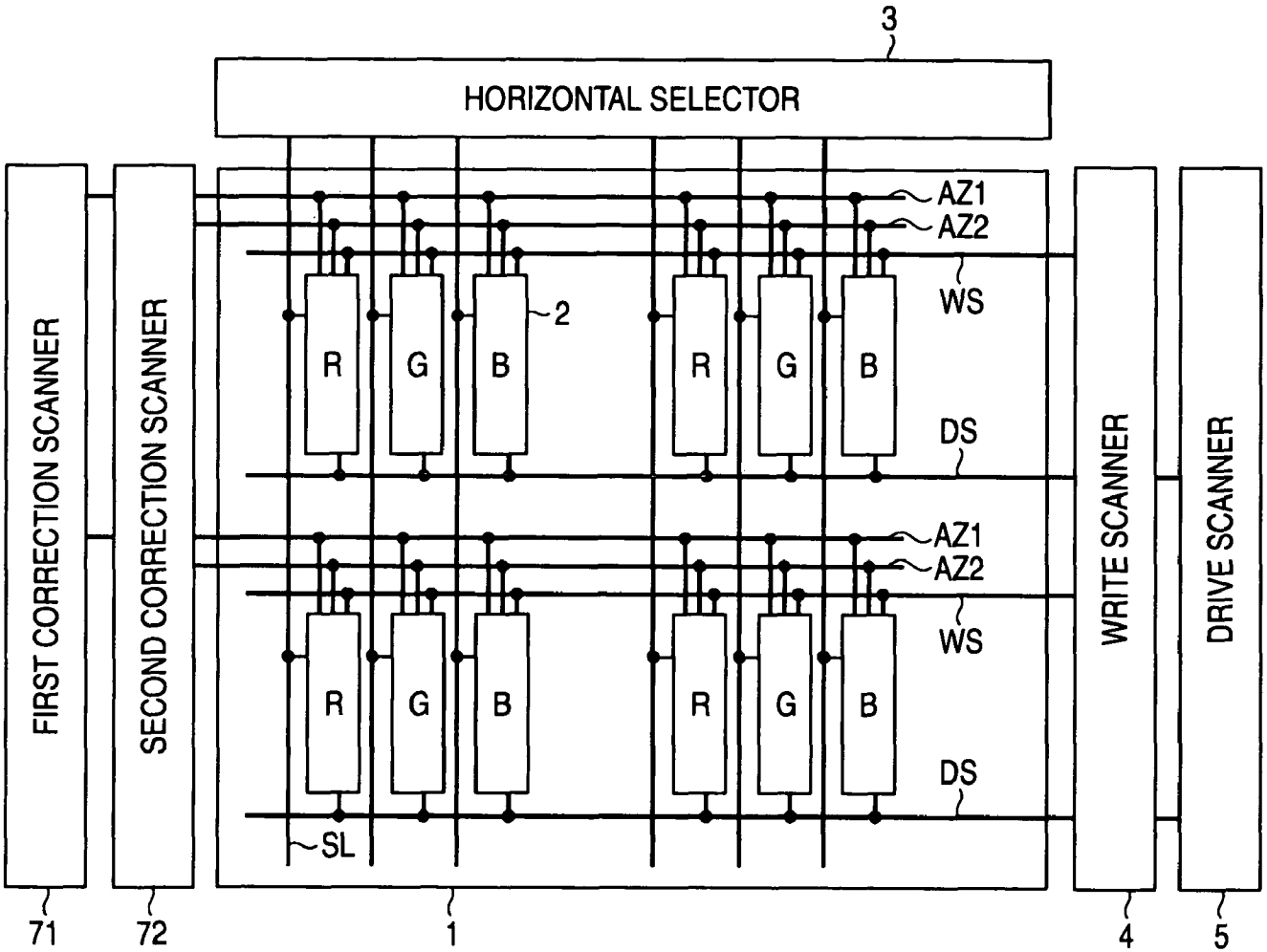
FIG. 1 is a block diagram showing the entire configuration of an image display device of an embodiment of the invention.

By referring to the accompanying drawings, an embodiment of the invention is described in detail. FIG. 1 is a block diagram showing the entire configuration of an image display device of the embodiment of the invention. As shown in the drawing, the image display device is configured, basically, to include a pixel array section 1, a scanner section, and a signal section. The pixel array section 1 is configured to include scan lines disposed in a line, i.e., a first scan line WS, a second scan line AZ2, a third scan line AZ1, and a fourth scan line DS, signal lines SL disposed in a row, pixel circuits 2, and a plurality of power lines. The pixel circuits 2 are arranged like a matrix, connected to the first to fourth scan lines WS, AZ2, AZ1, and DS, and the signal lines SL. The power lines are for supplying a first potential Vofs, a second potential Vini, and a third potential Vcc, which are all needed for operation of the pixel circuits 2. The signal section is a horizontal selector 3, and supplies a video signal to the signal lines SL. The scanner section is configured to include a light scanner 4, a drive scanner 5, and first and second correction scanners 71 and 72, which respectively supply a control signal to the first scan line WS, the fourth scan line DS, the third scan line AZ1, and the second scan line AZ2 so that the pixel circuits are sequentially scanned on a line basis.

Figure 2:
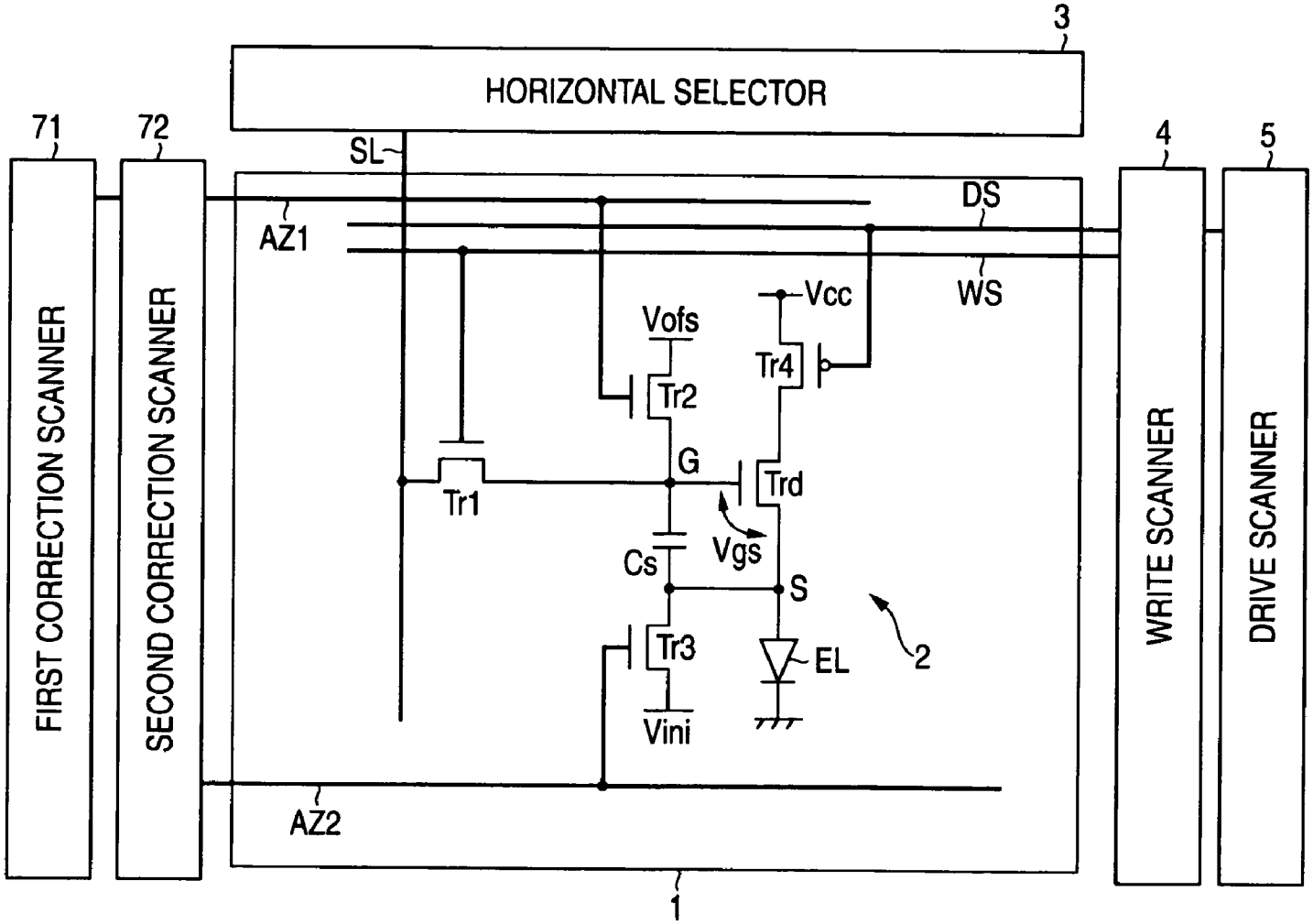
FIG. 2 is a circuit diagram showing a pixel formed to the image display device of FIG. 1.

FIG. 2 is a circuit diagram showing the configuration of a pixel circuit for incorporation into the image display device of FIG. 1. As shown in the drawing, the pixel circuit 2 is configured to include an input transistor Tr1, a drive transistor Trd, first to third switching transistors Tr2, Tr3, and Tr4, a retention capacity Cs, and a light-emitting device EL. The input transistor Tr1 is connected, at one current end, i.e., a source or a drain, to a gate node G of the drive transistor Trd, and samples a video signal at the retention capacity Cs during any predetermined sampling period. That is, the input transistor Tr1 is activated in response to a control signal coming from the first scan line WS during the predetermined sampling period, and samples the potential of the video signal provided by the signal lines SL so as to be at the retention capacity Cs. The retention capacity Cs applies an input voltage Vgs to the gate G of the drive transistor Trd in accordance with the potential of the sampled video signal. The drive transistor Trd supplies an output current Ids corresponding to the input voltage Vgs to the light-emitting device EL. The light-emitting device EL emits light of a level corresponding to the potential of the video signal using the output current Ids provided by the drive transistor Trd during any predetermined light emission period.

The first switching transistor Tr2 is activated in response to a control signal provided by the second scan line AZ2 prior to the sampling period, and sets the gate G of the drive transistor Trd to a first potential Vofs. The second switching transistor Tr3 is activated in response to a control signal provided by the third scan line AZ1 prior to the sampling period, and puts a source S of the drive transistor Trd on charge at the second potential Vini. The third switching transistor Tr4 is activated in response to a control signal provided by the fourth scan line DS prior to the sampling period, and connects the drive transistor Trd to the third potential Vcc. As such, the voltage corresponds to the threshold voltage Vth of the drive transistor Trd at the retention capacity Cs so that any details affected by the threshold voltage Vth are corrected. This third switching transistor Tr4 is activated in response to a control signal provided by the fourth scan line DS again during the light-emission period, and connects the drive transistor Tr3 to the third potential Vcc so that the output current Ids is made to flow through the light-emitting device EL.

As is evident from the description above, the pixel circuit 2 is configured by five transistors, i.e., Tr1 to Tr4 and Trd, a retention capacity Cs, and a light-emitting device EL. The transistors Tr1 to Tr3 and Trd are each an N-channel polysilicon TFT. Only the transistor Tr4 is a P-channel polysilicon TFT. The invention is surely not restricted thereto, and N- and P-channel TFTs may be combined as appropriate for use. The light-emitting device EL is an organic EL device of a diode type including an anode and a cathode, for example. The invention is surely not restricted thereto, and in this specification, a light-emitting device generally includes every type of electro-optic device that emits light with current drive. The electro-optic device has rectification properties, and is connected, at an anode to the source node S of the drive transistor Trd. Through such a connection, the intensity of an electro-optic device is determined by the value of the drive current Ids provided from the drive transistor Trd.

Figure 3:
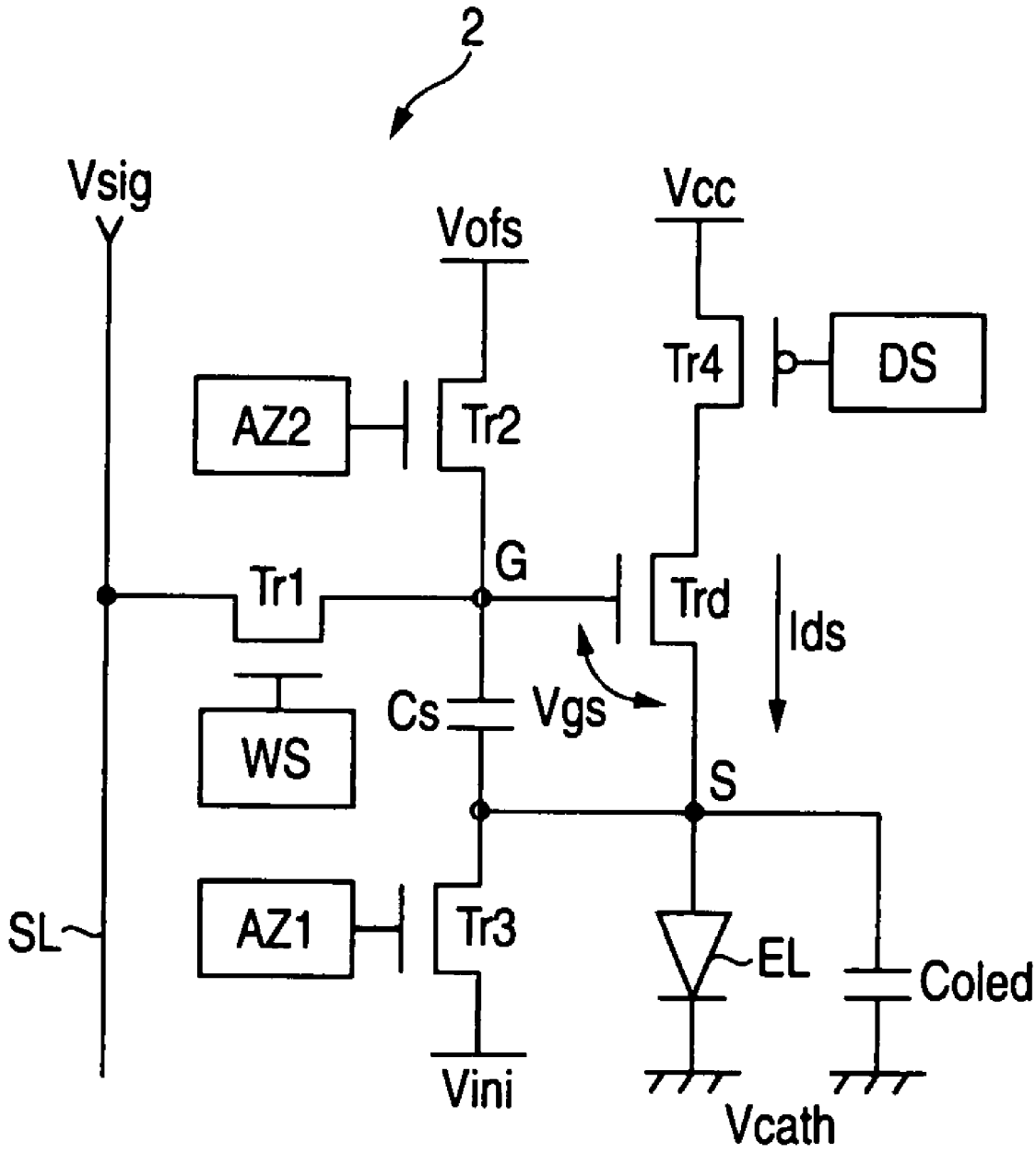
FIG. 3 is a schematic diagram for use in illustrating the operation of the pixel circuit of FIG. 2.

FIG. 3 is a schematic diagram showing only a portion of the pixel circuit 2 extracted from the image display device of FIG. 2. To facilitate understanding, FIG. 2 also shows a video signal Vsig that is to be sampled by the input transistor Tr1, an input voltage Vgs and an output current Ids of the drive transistor Trd, a capacity component Coled of the light-emitting device EL, and others. By referring to FIG. 3, described next is the operation of the pixel circuit 2 according to the embodiment of the invention.

Figure 4:
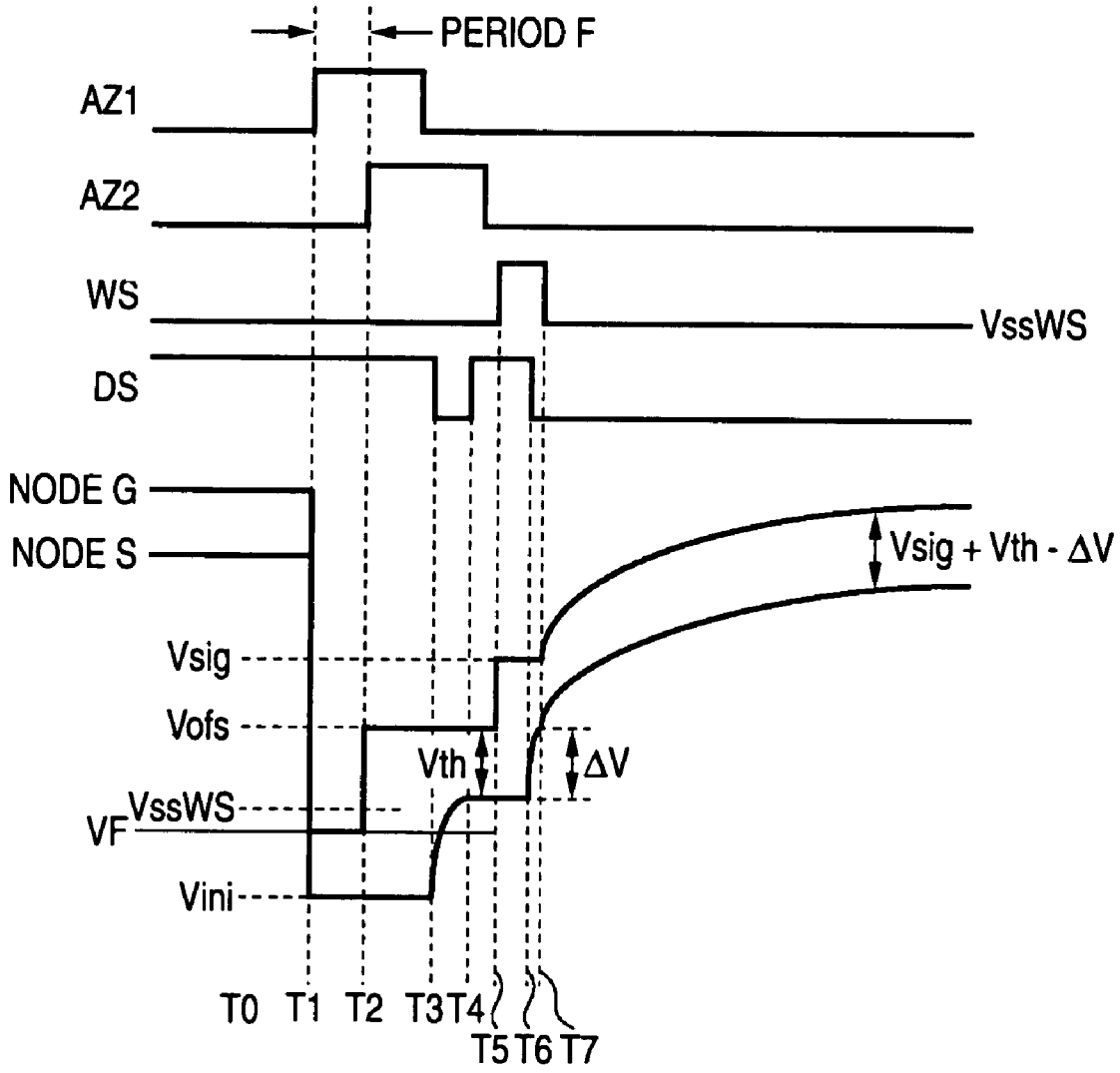
FIG. 4 is a timing chart, for reference use, showing an exemplary drive mode, of the image display device of FIGS. 2 and 3.

FIG. 4 is a timing chart of the pixel circuit of FIG. 3. Note here that this does not represent the drive method according to the embodiment of the invention but represents a drive method of a reference example. For providing a clear understanding of the invention, by referring to the reference example of FIG. 4, described first is the operation of the pixel circuit of FIG. 3.

FIG. 4 shows the waveform of a control signal for application to the scan lines WS, AZ2, AZ1, and DS along a time axis T. For the sake of simplification, the control signal is under the same reference numeral as the corresponding scan line. As each are of an N-channel, the transistors Tr1, Tr2, and Tr3 are turned on when the scan lines WS, AZ2, and AZ1 are each at a high level, and are turned off when these scan lines are each at a low level. On the other hand, as it is of a P-channel, the transistor Tr4 is turned off when the scan line DS is at a high level, and is turned on when the scan line is at a low level. Note here that this timing chart represents, together with the waveforms of the control signals WS, AZ1, AZ2, and DS, the potential change of the gate G of the drive transistor Trd, and that of the source S thereof.

In the timing chart of FIG. 4, the state changes of the control signals observed during a field are represented by timings T1 to T7. During a field, the pixel array is subjected to sequential scanning for every line. The timing chart represents the waveforms of the control signals WS, AZ1, AZ2, and DS, which are applied to pixels of a line. Note here that VssWS denotes a reference potential of the control signal WS for application to a gate of the input transistor Tr1.

At a timing T0 before the field begins, the control signals WS, AZ2, and AZ1 are all at a low level, and the N-channel transistors Tr1 to Tr3 are thus all in the OFF state. The control signal DS is at a high level, and thus the P-channel transistor Tr4 is also in the OFF state. As such, at the timing T0 the transistors Tr1 to Tr4 are all in the OFF state. At this time, the gate G (hereinafter, sometimes referred to as node G) and the source S (hereinafter, sometimes referred to as node S) of the drive transistor Trd each remain at a specific potential, but from the viewpoint of the circuit, those are each in a floating state because every transistor is in the OFF state.

At the timing T1 when the field begins, the control signal AZ1 is changed in level to high so that the switching transistor Tr3 is turned on. As a result, the source S of the drive transistor Trd is connected to the reference potential Vini. That is, the potential of the node S is abruptly dropped down to the reference potential Vini. At this time, as it is at a floating potential, the node G is affected by the abrupt potential reduction of the node S, whereby the potential of the node G is reduced down to VF. The potential VF of the node G is sometimes reduced lower than the reference potential VssWS of the control signal WS.

At the timing T2 after the lapse of a period F from the timing T1, the control signal AZ2 rises, and the switching transistor Tr2 is turned on. As a result, the gate G of the drive transistor Trd is connected to the reference voltage Vofs. In this stage, the node S is already connected to the reference potential Vini. Here, as a preparation for the Vth correction to be made at the subsequent timing T3, Vofs−Vini>Vth is assumed to be being satisfied so that Vofs−Vini=Vgs>Vth is established. In other words, the periods T1 to T3 are equivalent to a reset period of the drive transistor Trd. A setting also is made to VthEL>Vini where VthEL denotes the threshold voltage of a light-emitting device EL. Accordingly, a negative bias is applied to the light-emitting device EL so that the light-emitting device EL is put in a so-called reverse bias state. This reverse bias state is needed to normally execute the Vth correction operation and the mobility correction operation that will be executed later.

At the timing T3, the control signal AZ1 is changed in level to low, and immediately after the timing T3, the control signal DS also is changed in level to low. As a result, the transistor Tr3 is turned off, and the transistor Tr4 is turned on. This makes the drain current Ids flow into the retention capacity Cs, and the Vth correction operation is responsively started. At this time, the gate G of the drive transistor Trd remains at the reference potential Vofs, and until the drive transistor Trd cuts off the flow, the current Ids keeps flowing. Once the flow is cut off, the source potential (S) of the drive transistor Trd reaches Vofs−Vth. At the timing T4 after the flow is cut off as such, the drain current puts the control signal DS back to the high level, and turns off the switching transistor Tr4. The drain current also puts the control signal AZ2 back to the low level, and turns off also the switching transistor Tr2. As a result, the threshold voltage Vth is retained and fixed to the retention capacity Cs. As such, the timings T3 to T4 are a period of detecting the threshold voltage Vth of the drive transistor Trd. In this example, this detection period T3-T4 is referred to as the Vth correction period.

At the timing T5 after the Vth correction as such, the control signal WS is changed in level to high, and the input transistor Tr1 is turned on so that a video signal Vsig is written to the retention capacity Cs. The retention capacity Cs is sufficiently small compared with the equivalent capacity Coled of the light-emitting device EL, and thus the larger part of the video signal Vsig is written to the retention capacity Cs. To be precise, a difference of the video signal Vsig from the reference potential Vofs, i.e., Vsig−Vofs, is written to the retention capacity Cs. As such, the voltage Vgs between the gate G and the source S of the drive transistor Trd is at a level that is an addition result of the previously-detected-and-retained threshold voltage Vth and the difference Vsig−Vofs of the sampling result this time, i.e., at a level of Vsig−Vofs+Vth. For the sake of clarity, assuming that Vofs=0V, the gate-source voltage Vgs is Vsig+Vth as shown in the timing chart of FIG. 4. Such sampling to the video signal Vsig is performed until the control signal WS is changed in level to low, i.e., until the timing T7. That is, the timings T5 to T7 are equivalent to a sampling period.

At the timing T6 before the timing T7 when the sampling period ends, the control signal DS is changed in level to low, and the switching transistor Tr4 is turned on. As a result, the drive transistor Trd is connected to the power source Vcc so that the pixel circuit that has been in the no-light-emission period is now in the light-transmission period. As such, in the period T6-T7 in which the input transistor Tr1 remains on and the switching transistor Tr4 is put on the ON state, the drive transistor Trd is subjected to a mobility correction. That is, in this example, the mobility correction is made in the period T6-T7, where the end portion of the sampling period is overlapping the start portion of the light-emission period. Note that, at the start portion of the light-emission period for mobility correction, the light-emitting device EL is actually in the reverse bias state, and thus never emits light. At the mobility correction period T6-T7, the drain current Ids goes into the drive transistor Trd while the gate G of the drive transistor Trd remains at the level of the video signal Vsig. With the setting of Vofs−Vth<VthEL, the light-emitting device EL is put in the reverse bias state, and thus derived are not the diode characteristics but the simple capacity characteristics. As such, the drain current Ids flowing into the drive transistor Trd is written to the capacity C=Cs+Coled, which is a combination of the retention capacity Cs and the equivalent capacity Coled of the light-emitting device EL. Accordingly, this increases the source potential (S) of the drive transistor Trd. This increase is denoted by ΔV in the timing chart of FIG. 4. The increase ΔV will be deducted from the gate-source voltage Vgs retained at the retention capacity Cs, thereby leading to the same result as with a negative feedback. As such, by applying a negative feedback of the output current Ids of the drive transistor Trd to the input voltage Vgs of the drive transistor Trd, the mobility μ can be corrected. Note that the amount of a negative feedback ΔV can be optimized by adjusting the time width t of the mobility correction period T6-T7.

At the timing T7, the control signal WS is changed in level to low, and the input transistor Tr1 is turned off. As a result, the gate G of the drive transistor Trd is cut off from the signal lines SL. Accordingly, this stops the application of the video signal Vsig so that the gate potential (G) of the drive transistor Trd is allowed to increase, and it is increased together with the source potential (S). During this time, the value of the gate-source voltage Vgs retained at the retention capacity Cs remains at (Vsig−ΔV+Vth). As the source potential (S) is increased, the light-emitting device EL is freed from the reverse bias state, and thus the light-emitting device EL starts emitting light in response to the flowing of the output current Ids thereinto. The relationship at this time between the drain current Ids and the gate voltage Vgs is expressed as the following equation 2 by substituting Vsig−ΔV+Vth into Vgs of the transistor characteristics equation 1 in the above.

$$Ids=k\mu(Vgs-Vth)2=k\mu(Vsig-\Delta V)2 \quad (2)$$

In the above equation 2, k=(1/2) (W/L) Cox is established. In the characteristics equation 2, the term of Vth is cancelled, and this tells that the output current Ids for supply to the light-emitting device EL is not dependent on the threshold voltage Vth of the drive transistor Trd. The drain current Ids is basically determined by the signal voltage Vsig of the video signal. In other words, the light-emitting device EL will emit light with an intensity corresponding to the video signal Vsig, which has been corrected by the amount of the negative feedback ΔV. This amount of correction ΔV just serves as if it cancels out any effects of the mobility μ positioned at the coefficient portion of the characteristics equation 2. Accordingly, the drain current Ids is substantially dependent only on the video signal Vsig. At the next predetermined timing, the control signal DS is changed in level to high, so that the switching transistor Tr4 is turned off, and when the light emission is completed, the field also is ended. In other words, the sequence of FIG. 4 is put back to the timing T0. The procedure then moves to the next field, and the operations, i.e., the Vth correction operation, the mobility correction operation, and the light emission operation, are repeated again.

Figure 5:
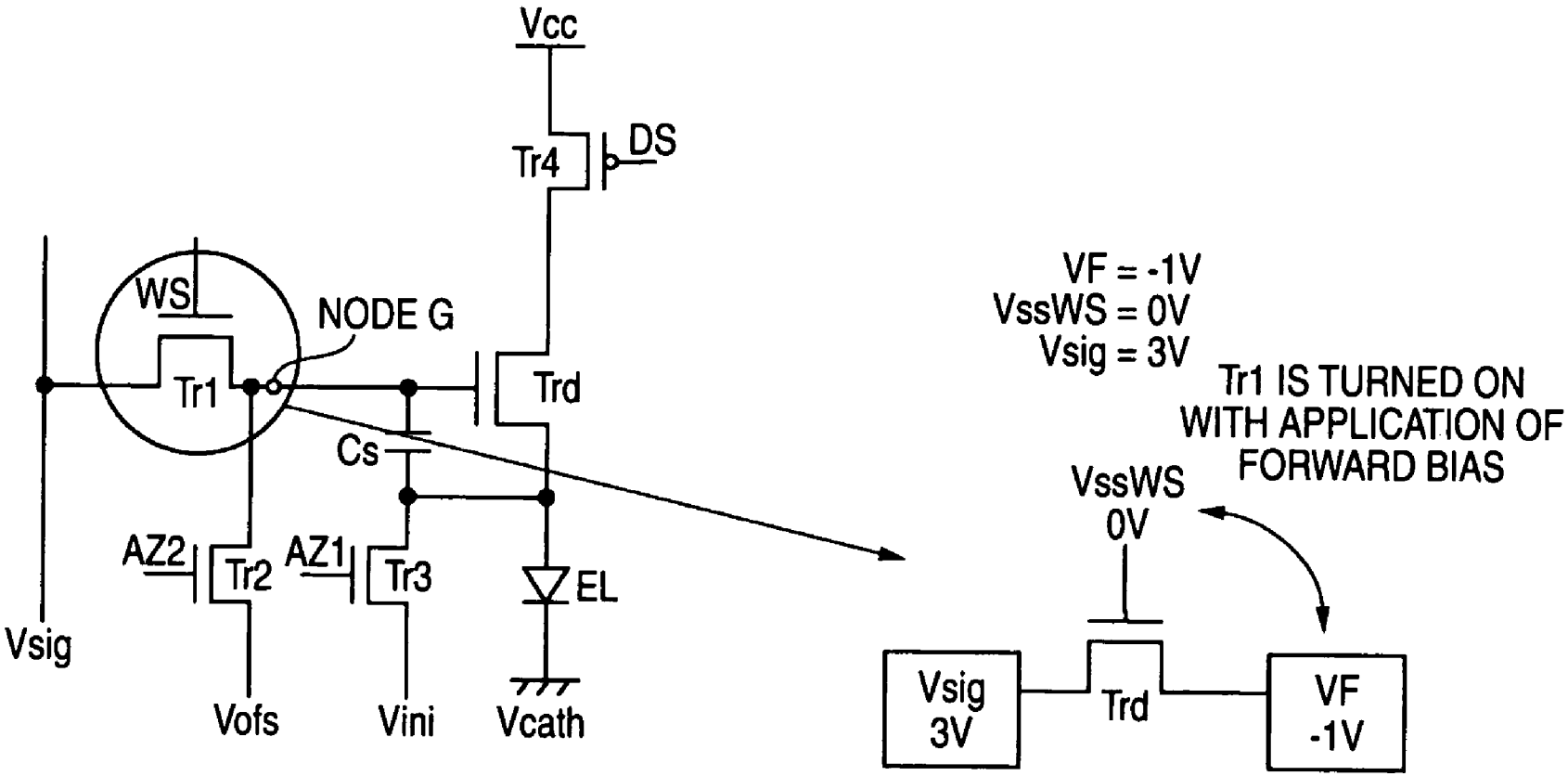
FIG. 5 is a schematic diagram for use in illustrating the reference example of FIG. 4.

FIG. 5 is a schematic diagram showing the potential state of the pixel circuit 2 in a field F of FIG. 4, i.e., the input transistor Tr1 is extracted from the pixel circuit 2, and the potential state thereof is schematically shown. As described above, in the field F, the input transistor Tr1 is in the OFF state. As such, the gate of the input transistor Tr1 is fixed to the reference potential VssWS of the control signal WS. To facilitate an understanding, a setting in the drawing is VssWS=0V. On the other hand, the potential of the node G is abruptly dropped down to the potential VF in the field F, and in some cases, this potential VF is lower than the reference potential VssWS. The FIG. 4 example shows VF=1V. As such, in this state, the side connected to the node G of the input transistor Tr1 serves as a source, and the potential thereof is −1V. On the other hand, the side connected to the signal line of the input transistor Tr1 serves as a drain, and, for example, the signal potential of Vsig=3V is being applied. In this potential state, the input transistor Tr1 is put in the ON state because the sequential bias is applied between the source and the gate. This causes a current leak to the input transistor Tr1, and the potential Vsig of the signal lines starts showing some change so as to be closer to the potential VF. As such, some voltage reduction is caused on the signal lines, thereby causing a reduction of the screen intensity. That is, the signal potential reduced by the current leak that occurred to the pixels of the line is sampled by the pixels of a preceding line, and this leads to the intensity reduction of the light-emitting devices. The pixels in the preceding line are already through with the threshold voltage correction operation, and with the sampling operation, these pixels may suffer from the influence of the reduction of the signal potential caused by the threshold voltage correction operation of the pixels in the next line. Because such an influence is caused in a row due to the sequential line scanning, the screen is problematically reduced in intensity in its entirety.

Figure 6:
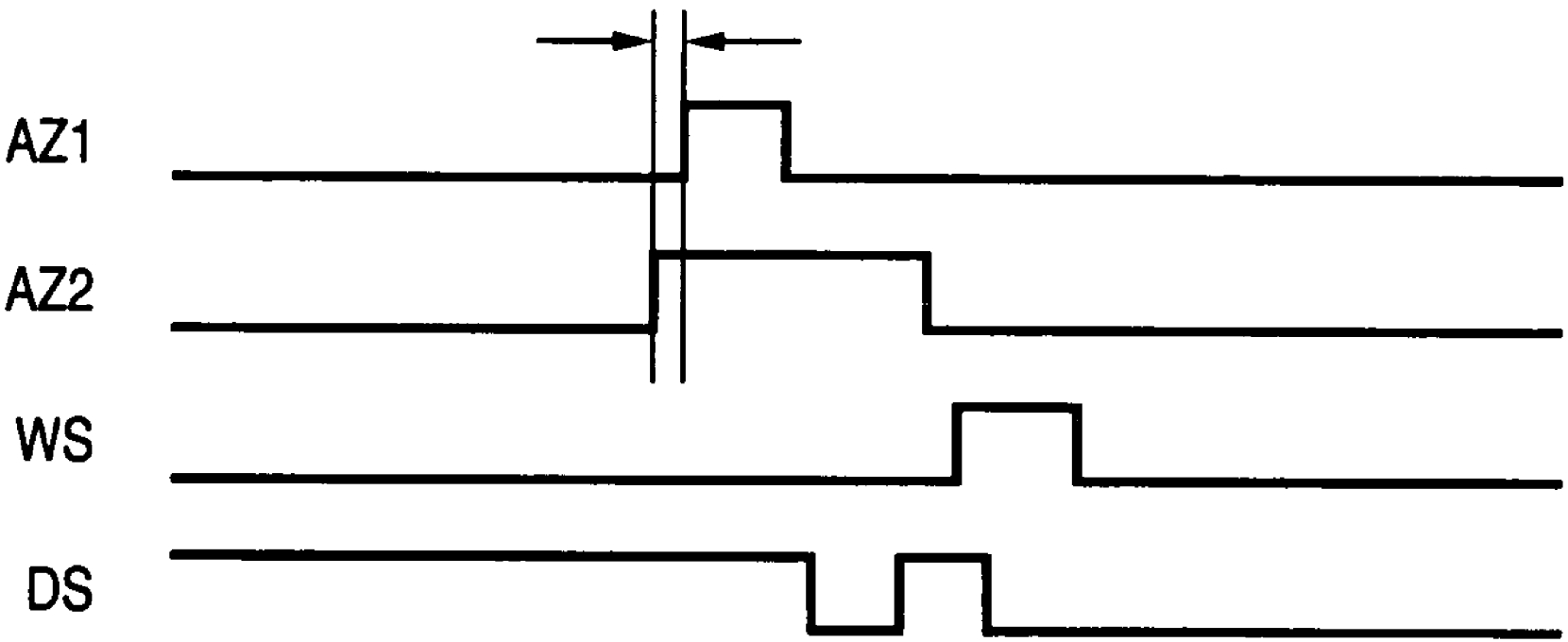
FIG. 6 is a timing chart showing another drive mode of the image display device of the embodiment of the invention.

FIG. 6 is a timing chart of a drive method of the image display device according to the embodiment of the invention. The timing chart shows, along a time axis, the state changes observed in the control signals AZ1, AZ2, WS, and DS. As is evident from the description made by referring to FIG. 5, the current leak observed in the input transistor is caused by the abrupt potential reduction of the node G in the period F. The cause thereof is the node G being in the floating state in the period F. In consideration thereof, the control sequence of FIG. 6 is one of not putting the node G in the floating state. That is, the control signal AZ2 first rises, and the switching transistor Tr2 is turned on first. Accordingly, this fixes the gate node G of the drive transistor Trd to the reference potential Vofs first of all, and therefore the node G is not put in the floating state. Thereafter, the control signal AZ1 rises after the lapse of a predetermined length of time so that the switching transistor Tr3 is turned on, and the node S is reset to the reference voltage Vini. As such, without putting the node G in the floating state, the gate and the source of the drive transistor Trd can be reset in value to their predetermined potentials. The input transistor is not applied with the sequential bias from the signal lines toward the pixel circuit, and thus no current leak is caused. After the drive transistor Trd is reset as such, the control signal AZ1 rises, and the control signal DS is changed in level to low so that the switching transistor Tr4 is turned on. In this manner, the threshold voltage correction operation is executed for the drive transistor Trd. Thereafter, the control signal WS rises, and then the signal potential of the video signal is then sampled. At this time, the drive transistor Trd is also subjected to a mobility correction.

Figure 7:
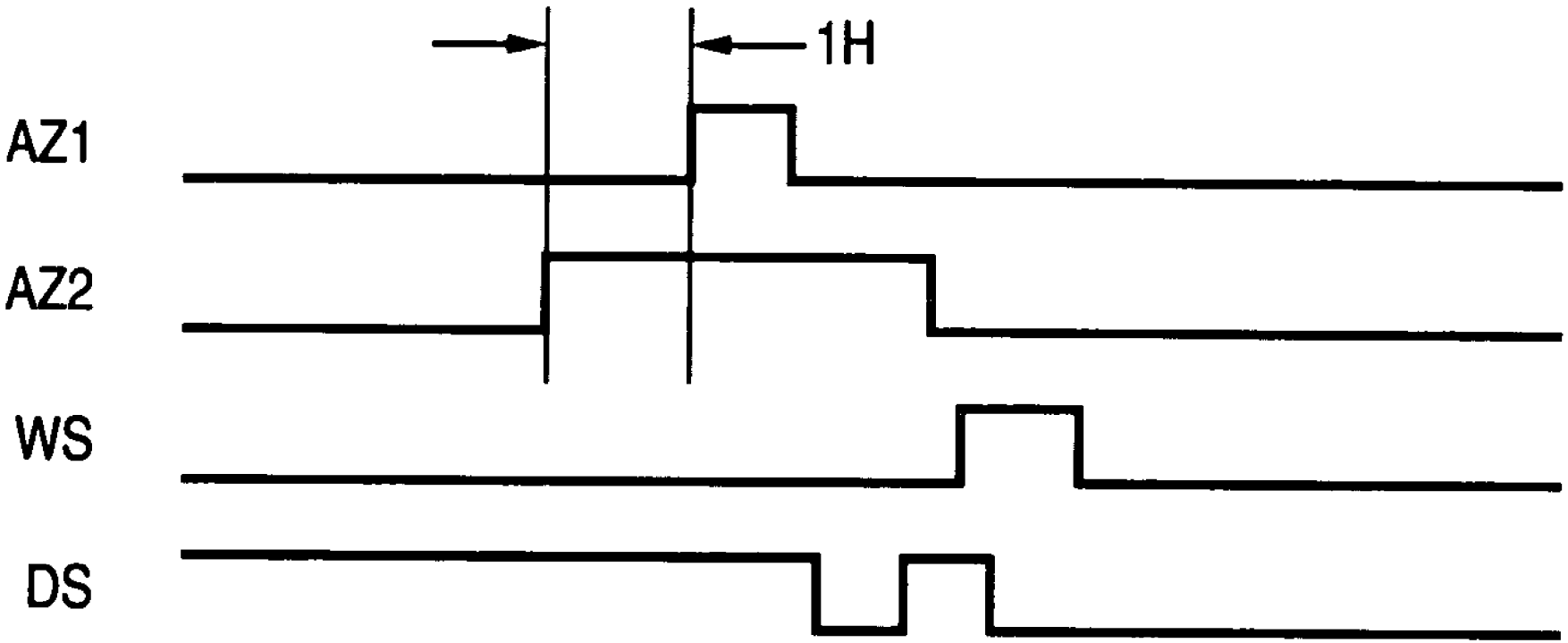
FIG. 7 is a timing chart showing still another drive mode of the image display device of the embodiment of the invention.

FIG. 7 is a timing chart of another exemplary drive method according to the embodiment of the invention. To facilitate an understanding, the timing chart is shown in a manner similar to that of FIG. 6. In this exemplary timing chart, the time difference between the control signals AZ1 and AZ2 to rise is monitored at every horizontal period (1H). This horizontal period 1H is the minimum unit of a transfer period for the correction scanners 71 and 72, and is so set as to reduce the time difference. If with a large time difference between the control signals AZ1 and AZ2 to rise, this means that the ON time is comprehensively increased for the control signals AZ1 and AZ2. Thereby, this shortens the ON time of the control signal DS, and this is the equivalent of shortening the maximum light emission period. As a result, the maximum level of the screen intensity is restricted, and thus is not considered preferable. As such, the shorter time difference is preferable between the control signals AZ1 and AZ2 to rise. In view of the operation, the ON time of the control signal AZ2 is required to overlap the ON time of the control signal DS, but the ON time of the control signal AZ1, is not allowed to overlap the ON time of the control signal DS. For the falling of the control signals AZ1 and AZ2, the Vth correction is required so that the control signal AZ2 is so set as to fall with the time interval of about 1H or 2H in accordance with the length of the Vth correction period after the falling of the control signal AZ1. After the falling of the control signal AZ1 but before the falling of the control signal AZ2, the control signal DS is turned on for the Vth control operation.

Figure 8:
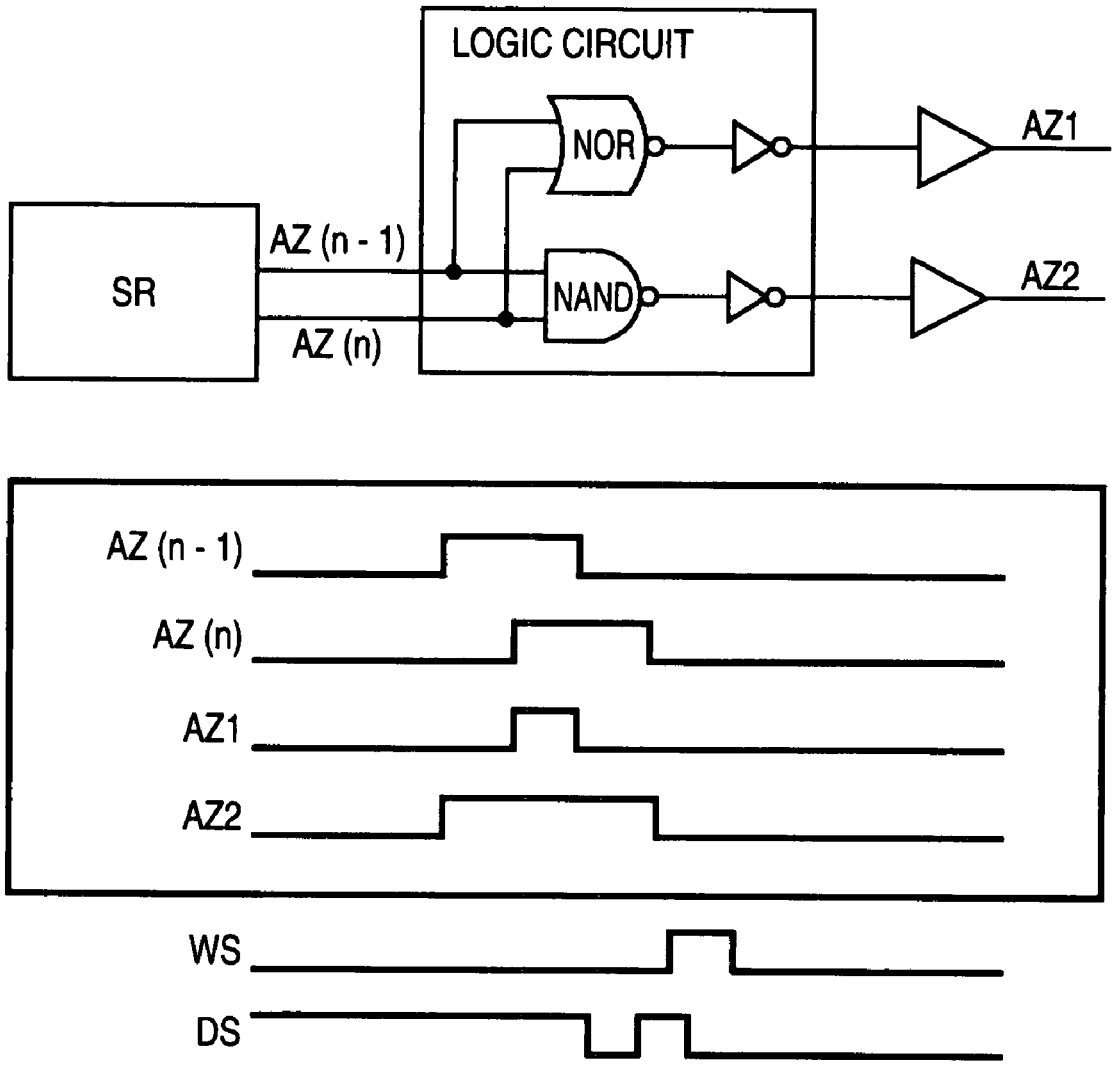
FIG. 8 is a schematic diagram showing an exemplary scanner section of the image display device of the embodiment of the invention.

FIG. 8 is a schematic diagram showing the circuit configuration for implementing the control sequence of FIG. 7. As is evident from FIG. 1, the control signals AZ1 and AZ2 are generated by the correction scanners 71 and 72, and are forwarded to their corresponding scan lines AZ1 and AZ2. In the FIG. 8 example, the first and second correction scanners 71 and 72 share the same shift register SR. The shift register SR outputs serial signals AZ(n−1) and AZ(n) with a phase difference for every horizontal period (1H). Compared with the serial signal AZ (n−1), the serial signal AZ (n) is output from the shift register SR only after an 1H. There is a logic circuit disposed between the shift register SR and the scan lines AZ1 and AZ2. This logic circuit is configured to include a NOR element, a NAND element, and two inverters. The logic circuit subjects the serial signals AZ (n−1) and AZ (n) provided by the shift register SR to a logic process, and generates the control signal AZ1 for turning on the switching transistor Tr3 and the control signal AZ2 for turning on the switching transistor Tr2.

Figure 9:
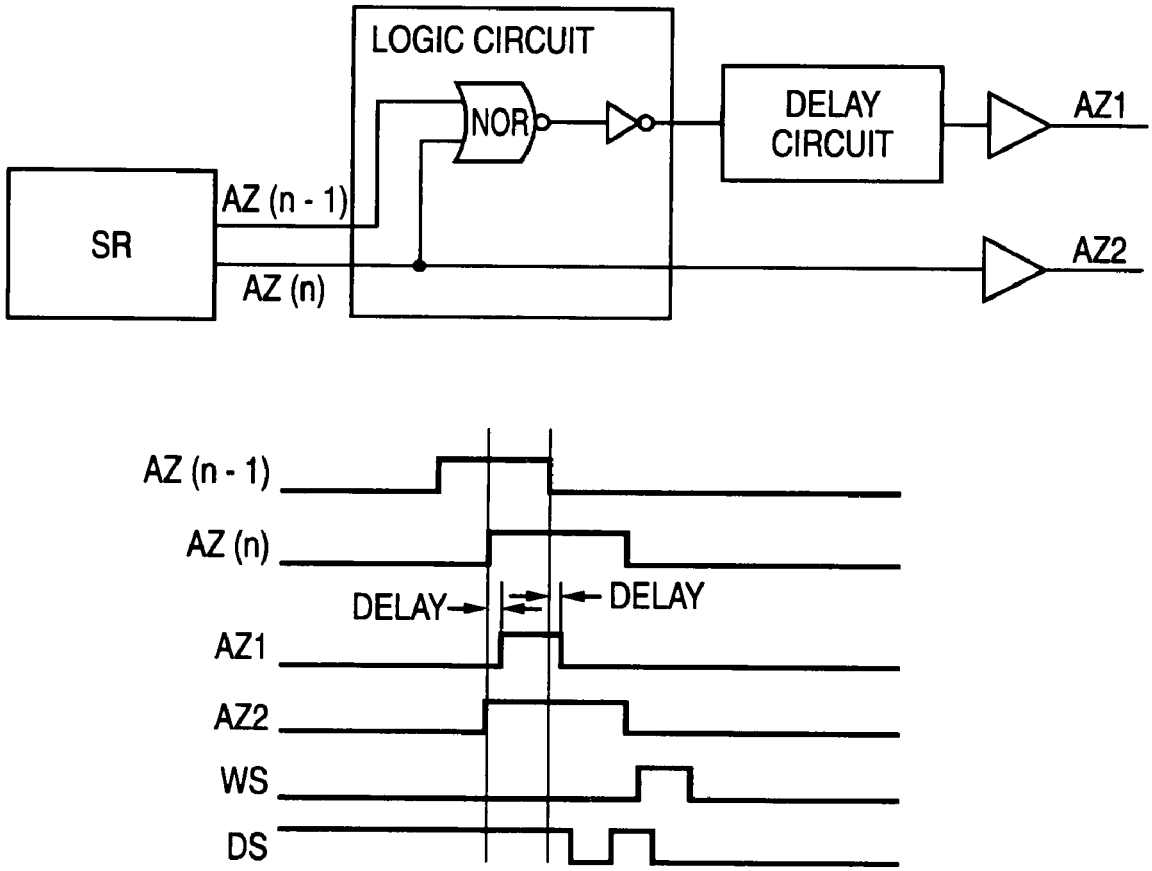
FIG. 9 is a circuit diagram and a timing chart showing another exemplary scanner section.

FIG. 9 is a schematic circuit diagram showing another exemplary scanner section. To facilitate an understanding, any component corresponding to the circuit diagram of FIG. 8 example is provided with the same reference numeral. This scanner section is configured to include a shift register SR for common use, a logic circuit, and a delay circuit. The shift register SR outputs the serial signals AZ (n−1) and AZ (n) with a phase difference of a horizontal period (1H). The logic circuit processes the serial signals AZ(n−1) and AZ(n), and outputs a pair of intermediate signals of the same phase. One of the intermediate signals is output as it is as the control signal AZ2 for use in turning on the switching transistor Tr2, and the remaining intermediate signal is subjected to a delay process by the delay circuit for output as the control signal AZ1 for use in turning on the switching transistor Tr3. As is evident from the timing chart, the control signal AZ1 basically has the same clock phase as the control signal AZ2. If a delay circuit is incorporated for the line outputting the control signal AZ1, the control signal AZ2 can rise before the control signal AZ1. This enables the reduction of the time difference between the control signals AZ1 and AZ2 to rise as much as possible. As such, the maximum light emission period can be longer than the drive method of FIG. 7.

Figure 10:
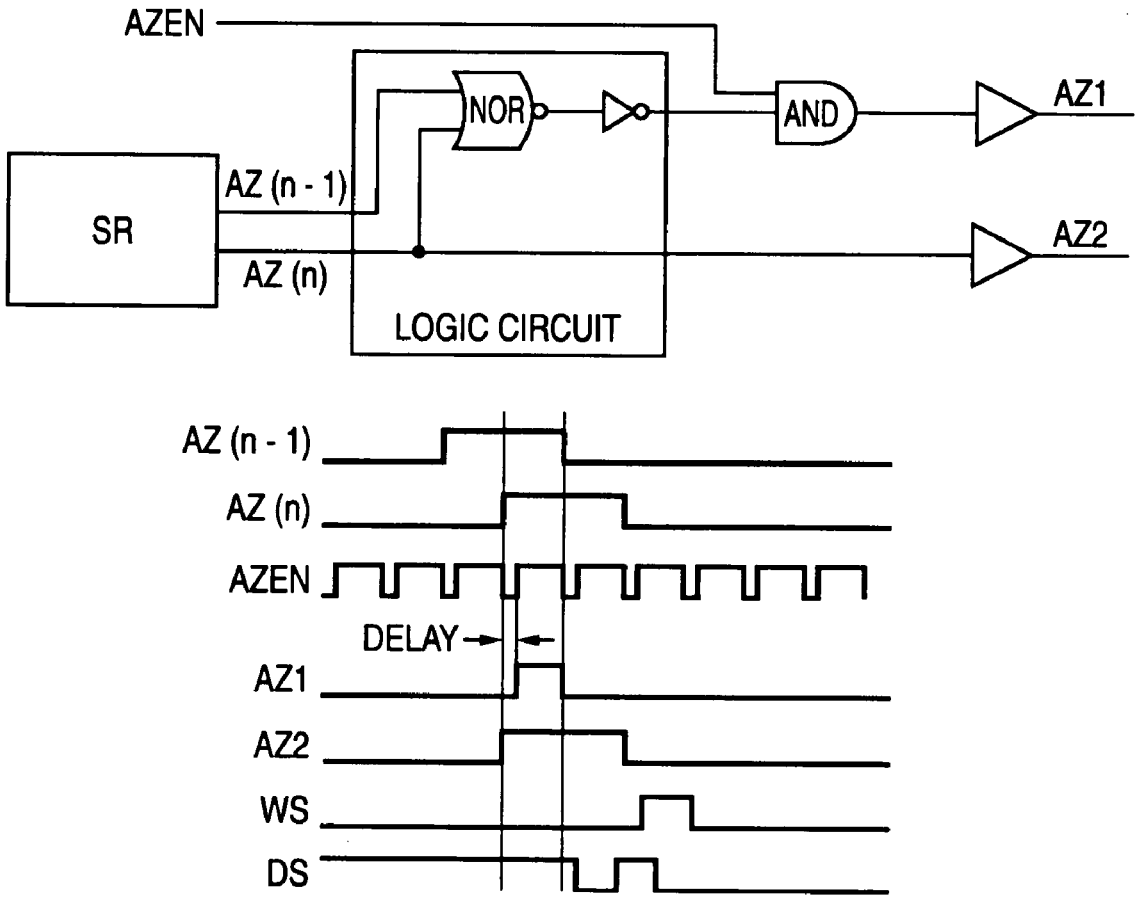
FIG. 10 is a circuit diagram and a timing chart showing still another exemplary scanner section.

FIG. 10 is a schematic circuit diagram and a timing chart of still another exemplary scanner section. To facilitate an understanding, any component corresponding to that of the scanner section of FIG. 9 example is provided with the same reference numeral. The scanner section of the embodiment includes a mask circuit of an AND element as an alternative to the delay circuit of FIG. 9. A shift register SR outputs the serial signals AZ(n−1) and AZ(n) with a phase difference of a horizontal period (1H). A logic circuit processes the serial signals AZ(n−1) and AZ(n), and outputs a pair of intermediate signals of the same phase. One of the intermediate signals is output as it is as the control signal Az2 for use in turning on the switching transistor Tr2, and the remaining intermediate signal is subjected to a mask process by the mask circuit for output as the control signal AZ1 for use to turn on the switching transistor Tr3. The mask circuit (AND element) masks the intermediate signal coming from the logic circuit using an enable signal AZEN coming from the outside, thereby deriving the eventual control signal AZ1. The mask circuit has the advantage of being able to freely adjust the rising timing of the control signal AZ1 through control over the pulse width of the enable signal AZEN.

Figure 11:
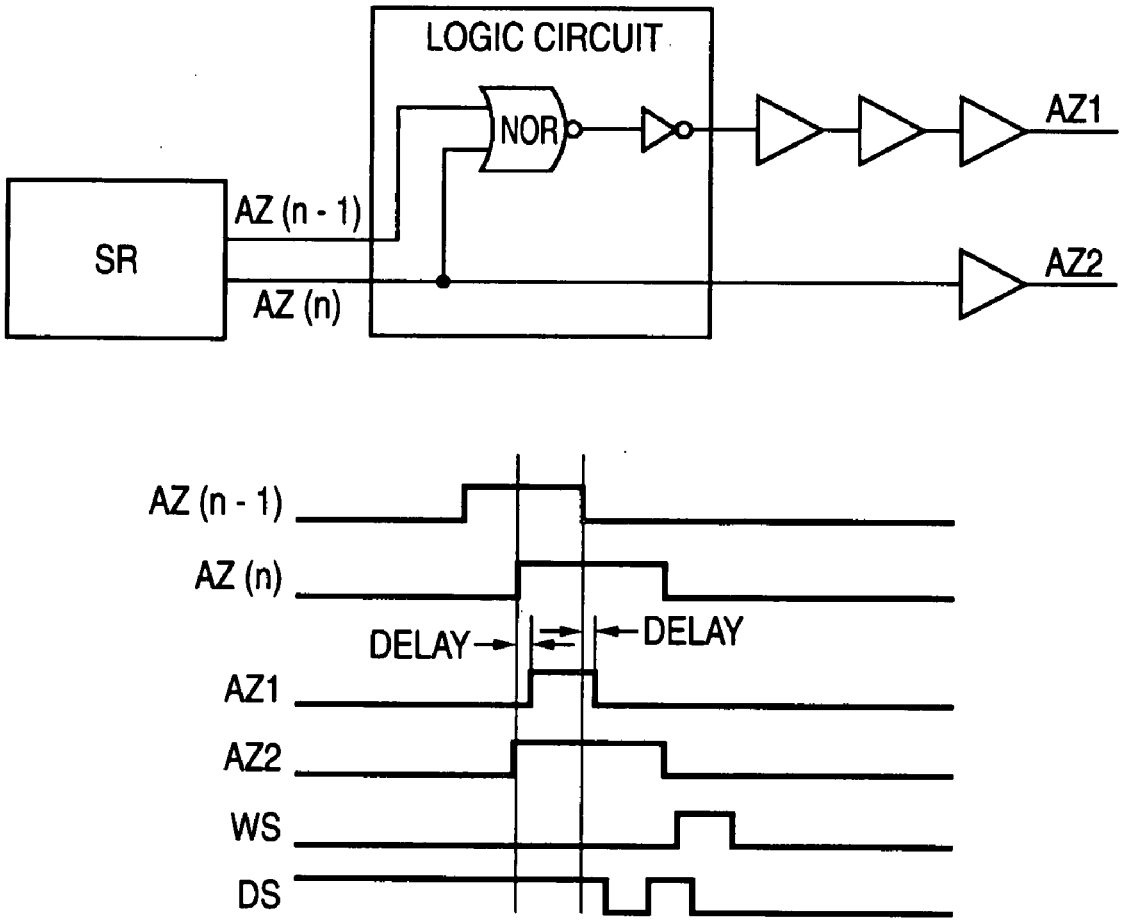
FIG. 11 is a circuit diagram and a timing chart showing still another exemplary scanner section.

FIG. 11 is a schematic circuit diagram and a timing chart of still another exemplary scanner section, i.e., output stage. To facilitate an understanding, any component corresponding to that of the scanner section of FIG. 9 example is provided with the same reference numeral. The difference from the scanner section of FIG. 9 lies in using a buffer as an alternative to the delay circuit. The buffer has the effect of delaying the signal transmission similarly to the delay circuit. As to a pair of intermediate signals of the same phase coming from the logic circuit, one of the intermediate signals is output as the control signal AZ2 for use in turning on the switching transistor Tr2 through the buffers smaller in number, e.g., one in the FIG. 11 example, and the remaining intermediate signal is output as the control signal AZ1 for use in turning on the switching transistor Tr3 through the buffers larger in number, e.g., three in the FIG. 11 example. In some cases, the size of the buffers may be changed instead of changing the number thereof. The larger the size of the buffers, the larger the drive capability becomes, whereby the delay amount is reduced.

Figure 12:
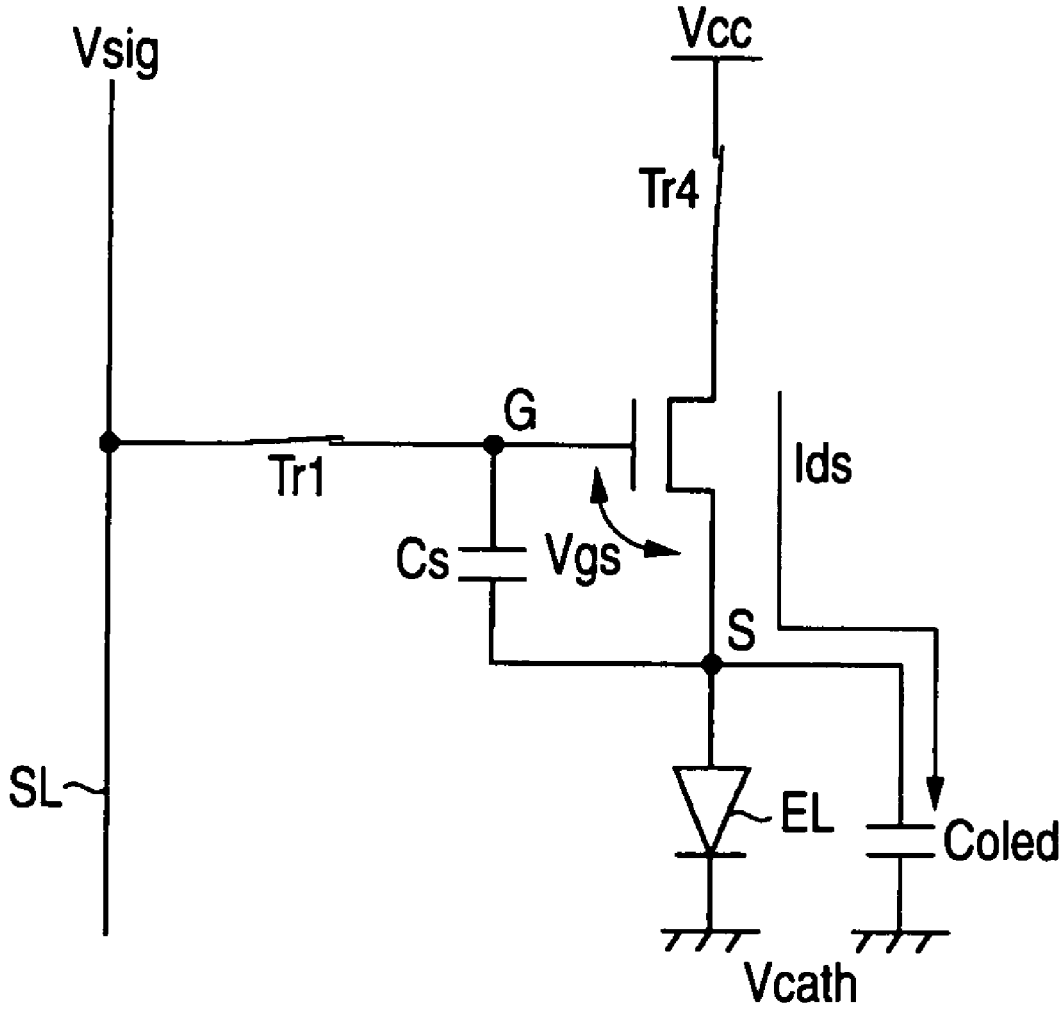
FIG. 12 is a circuit diagram showing the mobility correction operation of the image display device of the embodiment of the invention.

Lastly, FIG. 12 is a circuit diagram showing the state of the pixel circuit 2 in the mobility correction period T6-T7. As shown in the drawing, in the mobility correction period T6-T7, the input transistor Tr1 and the switching transistor Tr4 are turned on but the remaining switching transistors Tr2 and Tr3 are turned off. In this state, the source potential (S) of the drive transistor Tr4 is Vofs−Vth. This source potential S is also the anode potential of the light emission device EL. As described above, with a setting of Vofs−Vth<VthEL, the light-emission device EL is put in the reverse bias state, and it does not show the diode characteristics but shows the simple capacity characteristics. As such, the current Ids flowing to the drive transistor Trd flows into the combined capacity C=Cs+Coled, i.e., the combination of the retention capacity Cs and the equivalent capacity Coled of the light emission device EL. In other words, the drain current Ids is partially negatively fed back to the retention capacity Cs so that the mobility is accordingly corrected.

Figure 13:
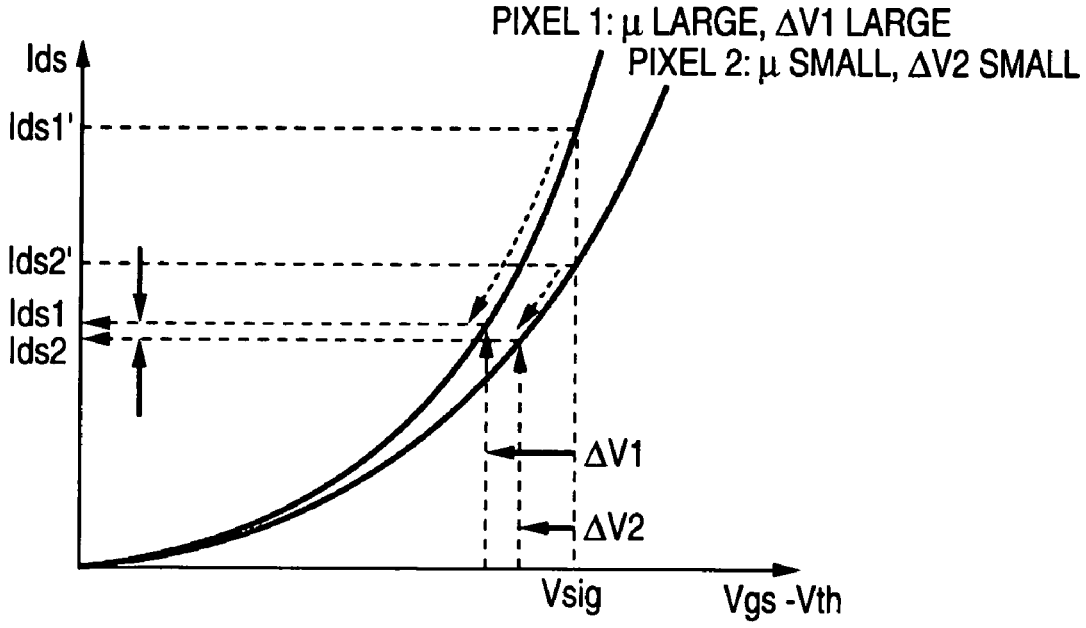
FIG. 13 is a graph also showing the mobility correction operation.

FIG. 13 is a graph of the transistor characteristics equation 2 in the above, and the vertical axis denotes the current Ids, and the lateral axis denotes the current Vsig. At the lower portion of this graph, the characteristics equation 2 is also shown. In the graph of FIG. 13, for comparison use, a characteristics curve is indicated for a pixel 1 and another for a pixel 2. The mobility μ of the drive transistor for the pixel 1 is relatively high, but the mobility μ of the drive transistor for the pixel 2 is relatively low. As such, when the drive transistor is configured by a polysilicon thin film transistor or others, the variation of the mobility μ is inevitable between the pixels. Assuming that the pixels 1 and 2 are each written with the video signal Vsig of the same level, some kind of mobility correction is required, otherwise an output current Ids1' flowing to the pixel 1 with the higher mobility μ will be largely different from an output current Ids2' flowing to the pixel 2 with the lower mobility μ. As such, because a large difference is caused between the output currents Ids due to the variation of the mobility μ, this impairs the uniformity of the screen.

In consideration thereof, in the embodiment of the invention, the output current is negatively fed back to the side of the input voltage so that any possible variation of mobility is cancelled. As is evident from the transistor characteristics equation, the larger mobility leads to the larger drain current Ids. As such, the amount of negative feedback ΔV is increased if with the higher mobility. As shown in the graph of FIG. 13, the amount of negative feedback ΔV1 for the pixel 1 with the higher mobility μ is larger than the amount of negative feedback ΔV2 for the pixel 2 with the lower mobility. This means that if with the higher mobility μ, the application degree of the negative feedback is increased, thereby favorably suppressing the variation. As shown in the drawing, if with any correction applied with the amount of correction ΔV1 for the pixel 1 with the higher mobility μ, the output current is largely reduced from Ids1' to Ids1. On the other hand, because the amount of correction ΔV2 for the pixel 2 with the lower mobility μ is small, the output current Ids2' is not reduced that much down to Ids2. As a result, the output current Ids1 becomes substantially equal to the output current Ids2 so that the variation of mobility is cancelled. This cancellation of the mobility variation is applied to the entire area of the video signal Vsig, i.e., from the black level to the white level, and thus the uniformity becomes considerably high for the screen. As such, if with pixels 1 and 2 each having a different mobility, the amount of correction ΔV1 for the pixel 1 with the higher mobility is smaller than the amount of correction ΔV2 for the pixel 2 with the lower mobility. That is, with the larger mobility, the correction amount ΔV is increased and the current Ids is increased to a further degree. As such, the pixel current values varying in mobility become uniform, thereby enabling the correction of any mobility variation.

Figure 14:
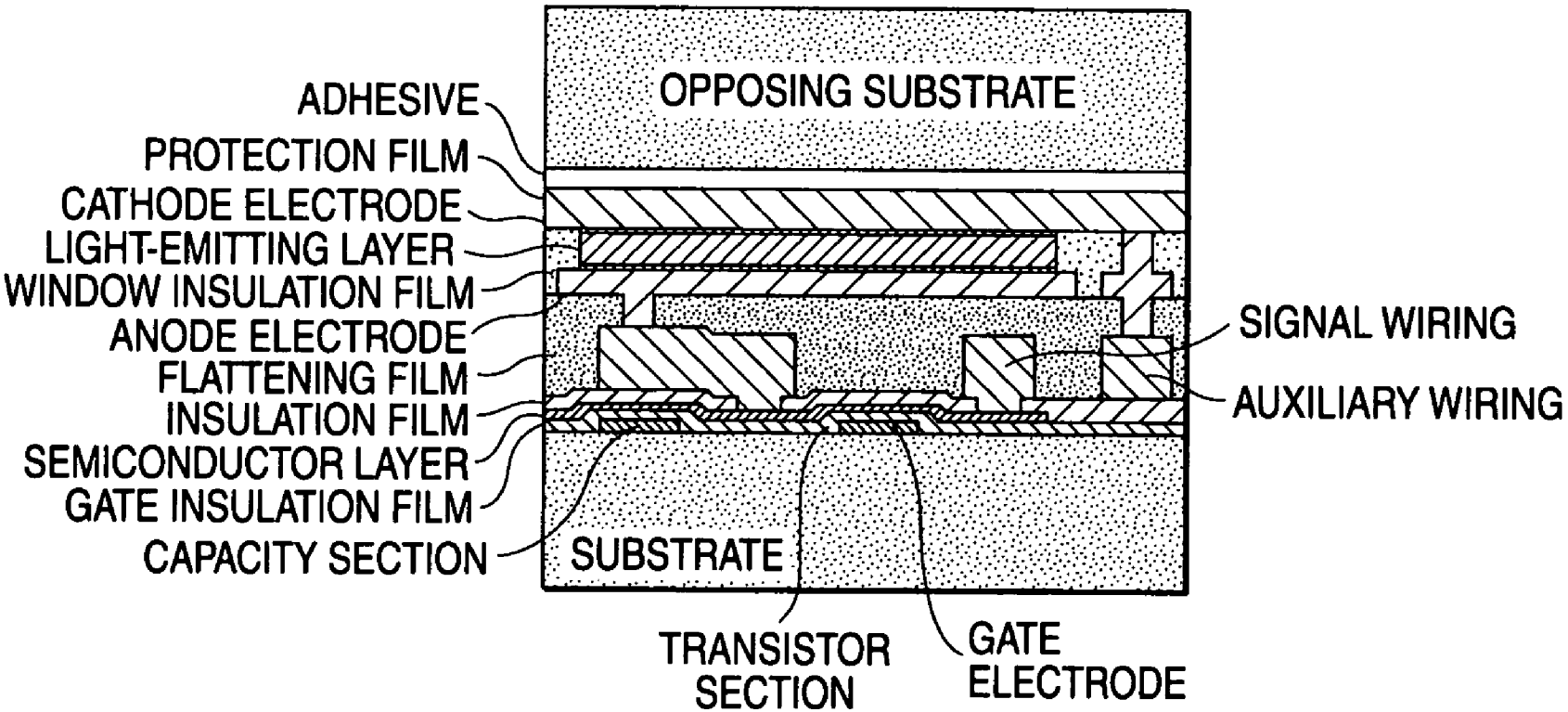
FIG. 14 is a cross sectional view of a display device of the embodiment of the invention, showing the device configuration thereof.

A display device according to the embodiment of the invention has the thin-film device configuration as shown in FIG. 14. FIG. 14 shows the schematic cross-sectional configuration of a pixel formed to an insulator substrate. As shown in the drawing, the pixel includes a transistor section including a plurality of thin-film transistors, e.g., one TFT in the drawing, a capacity section, such as retention capacity, and a light-emission section, such as organic EL device. The substrate is formed thereon with the transistor section and the capacity section through a TFT process, and the light emission section, such as organic EL device, is disposed thereon. A transparent opposing substrate is affixed using an adhesive thereon so that a flat panel is configured.

Figure 15:
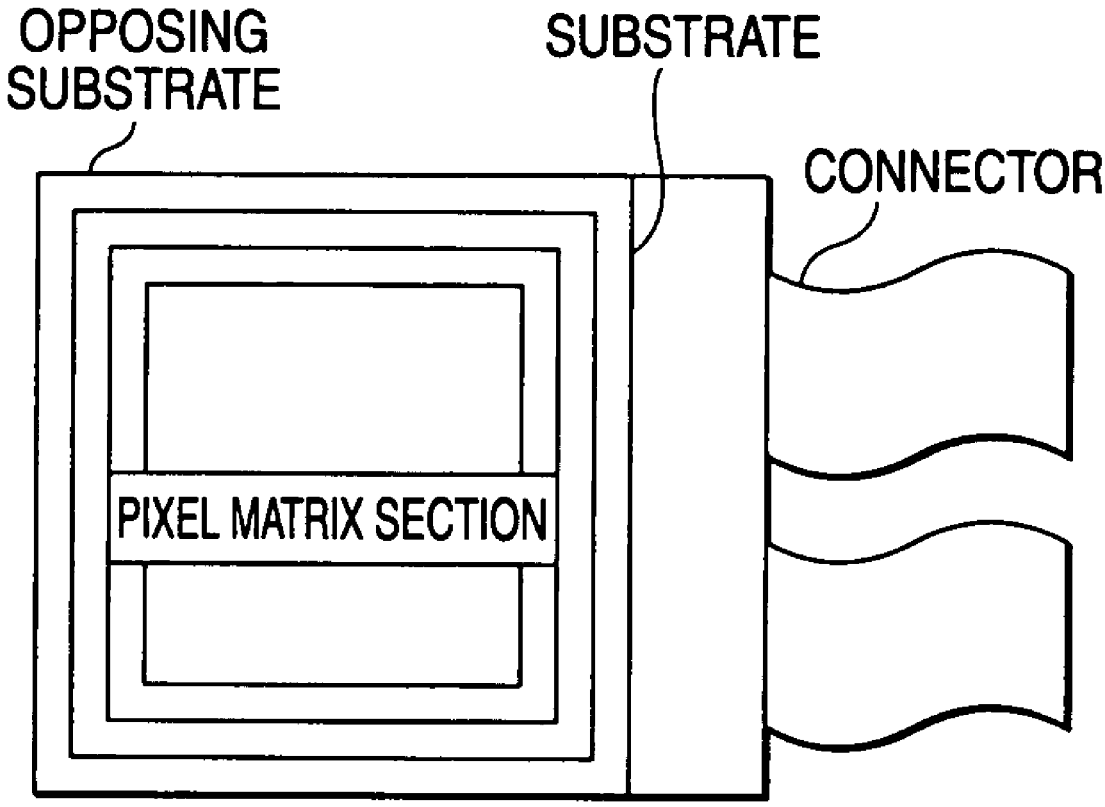
FIG. 15 is a plan view of the display device of the embodiment of the invention, showing the module configuration thereof.

The display device according to the embodiment of the invention is also of a flat-type module as shown in FIG. 15. As an example, an insulator substrate is formed thereon with a pixel array section including a plurality of pixels arranged in a matrix. The pixels are each configured by an organic EL device, a thin-film transistor, a thin-film capacity, and others. The adhesive is disposed so as to enclose the pixel array section (pixel matrix section), and the opposing substrate made of glass or others is affixed so that the result is a display module. This transparent opposing substrate may be a color filter, a protection film, a light shield film, and others as appropriate. The display module may be provided with a FPC (Flexible Printed Circuit) for use as a connector for signal input/output from/to outside to/from the pixel array section.

The display device described as above is in the flat panel shape, and is capable of applying a video signal provided to or generated in various types of electronic devices, e.g., a digital camera, a notebook personal computer, a mobile phone, and a video camera, as image or video on displays of electronic devices of various fields. Exemplified below is an exemplary electronic device to which such a display device is applied.

Figure 16:
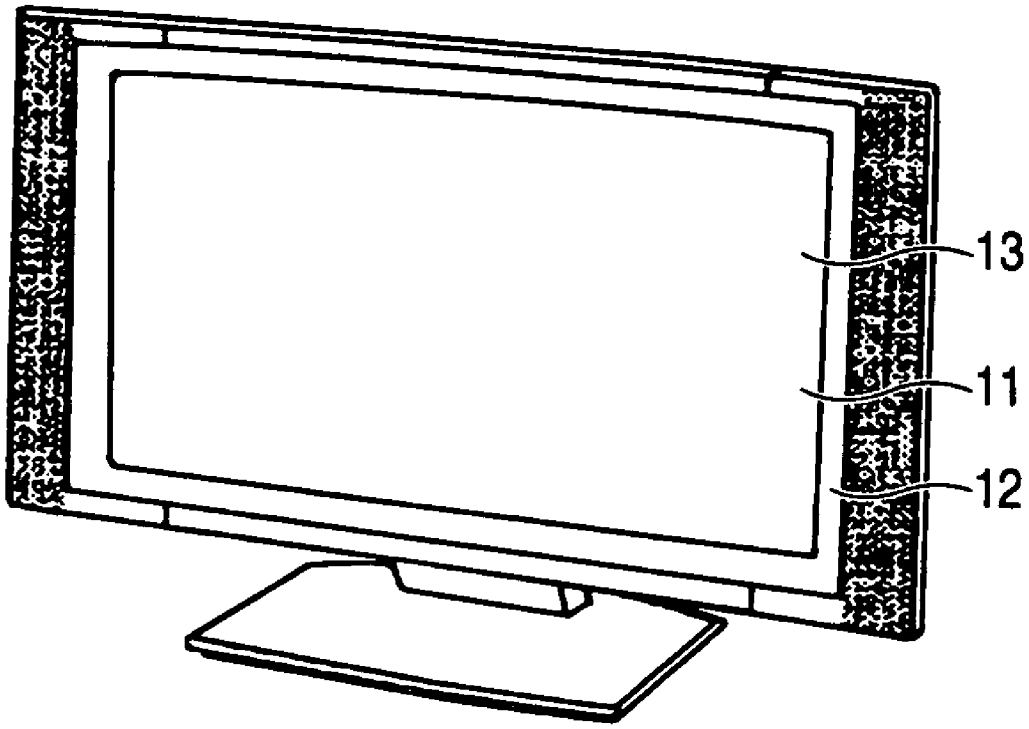
FIG. 16 is a perspective view of a television set equipped with the display device of the embodiment of the invention.

FIG. 16 is a television to which the invention is applied, and includes a video display screen 11 configured by a front panel 12, a filter glass 13, and others, and is manufactured by using the display device according to the embodiment of the invention to the video display screen 11.

Figure 17:
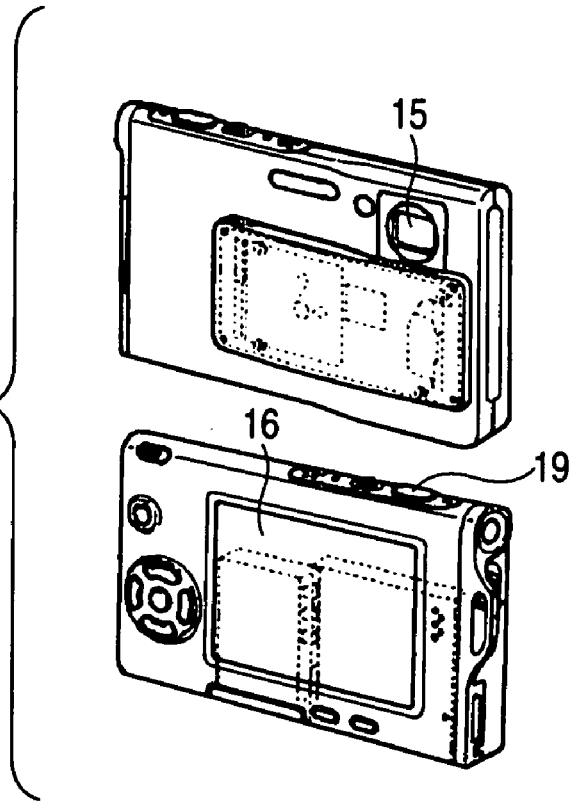
FIG. 17 is a perspective view of a digital still camera equipped with the display device of the embodiment of the invention.

FIG. 17 is a digital camera to which the invention is applied, and the upper diagram is of the front view, and the lower diagram is of the rear view. This digital camera is configured to include an imaging lens, a light-emission section 15 for flash use, a display section 16, a control switch, a menu switch, a shutter 19, and others, and is manufactured by using the display device according to the embodiment of the invention in the display section 16.

Figure 18:
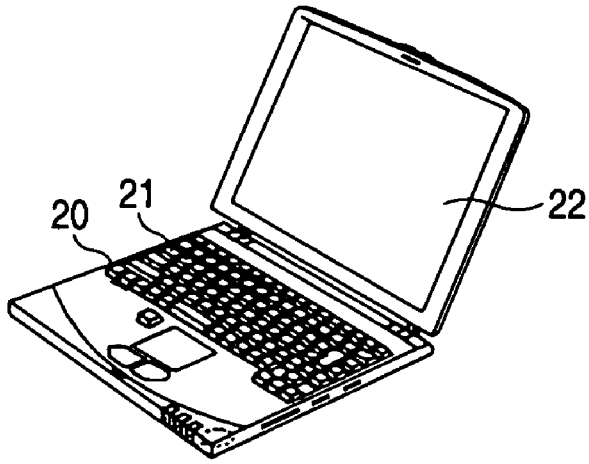
FIG. 18 is a perspective view of a notebook personal computer equipped with the display device of the embodiment of the invention.

FIG. 18 is a notebook personal computer to which the invention is applied, and a main body 20 includes a keyboard 21 to be operated for the input of characters or others. The cover of the body 20 is provided with a display section 22 for the display of images, and is manufactured by using the display device according to the embodiment of the invention in the display section 22.

Figure 19:
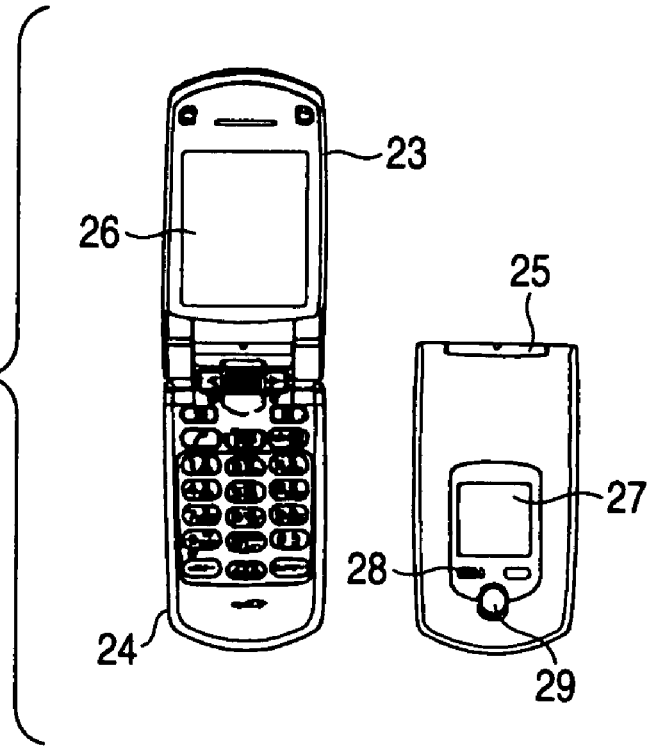
FIG. 19 is a schematic view of a portable terminal device including the display device of the embodiment of the invention.

FIG. 19 is a portable remote terminal to which the invention is applied, and the left diagram shows the state in which the terminal is open, and the right diagram shows that in which the terminal is closed. This portable remote terminal is configured to include an upper cabinet 23, a lower cabinet 24, a coupling section (hinge section in this example) 25, a display 26, a sub display 27, a picture light 28, a camera 29, and others, and is manufactured by using the display device according to the embodiment of the invention in the display 26 or the sub display 27.

Figure 20:
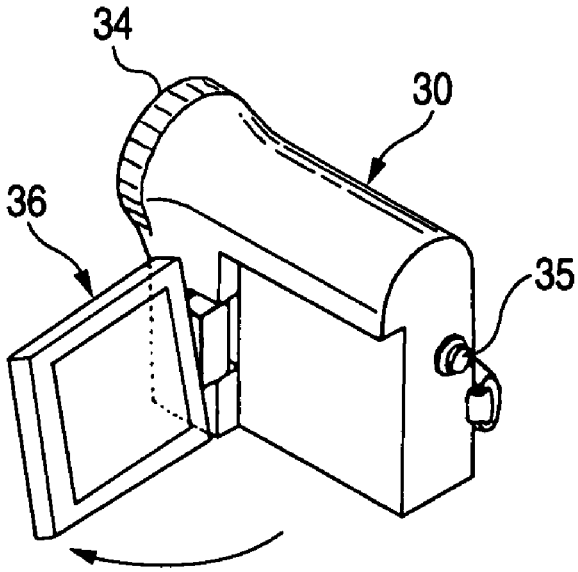
FIG. 20 is a perspective view of a video camera including the display device of the embodiment of the invention.

FIG. 20 is a video camera to which the invention is applied, and is configured to include a body section 30, a lens 34 for imaging of an object provided on the side when the video camera is directed toward the front, a start/stop switch 35 for imaging, a monitor 36, and others, and is manufactured by using the display device according to the embodiment of the invention in the monitor 36.

It should be understood by those skilled in the art that various modifications, combinations, subcombinations and alterations may occur depending on design requirements and other factors insofar as they are within the scope of the appended claims or the equivalents thereof.

What is claimed is:

1. A pixel circuit, comprising, at least:

a drive transistor;

an input transistor;

a first switching transistor;

a second switching transistor;

a retention capacity; and an electro-optic device, wherein the retention capacity is connected, at both ends, to a gate node and a source node, respectively, of the drive transistor, the electro-optic device has rectification properties, and is determined in intensity by a value of a drive current coming from the drive transistor whose source node is connected to an anode thereof, the input transistor is connected, at one current end, to the gate node of the drive transistor, and samples a video signal to the retention capacity during a predetermined sampling period, the first switching transistor is turned on before the sampling period, and connects the gate node of the drive transistor at a predetermined reference voltage, the second switching transistor is turned on before the sampling period, and puts, on charge, the source node of the drive transistor, i.e., the anode of the electro-optic device, to be equal to or lower than a threshold voltage of the electro-optic device, and a timing setting is made to a control signal for application to gates of the first and second switching transistors in such a manner that the first switching transistor is turned on before the second switching transistor.

2. The pixel circuit according to claim 1, wherein the timing setting is made to the control signal in such a manner that the second switching transistor is turned on with a lapse of a horizontal period after the first switching transistor is turned on.

3. An electronic device including the display device of claim 1.

4. An image display device, comprising:

a pixel array section;

a scanner section; and a signal section, wherein the pixel array section includes first to third scan lines disposed in a line, signal lines disposed in a row, matrix-shaped pixel circuits connected to the scan lines and the signal lines, and a plurality of power lines that supply first and second potentials needed for operation of the pixel circuits, the signal section supplies a video signal to the signal lines, the scanner section sequentially scans the pixel circuits, on a line basis, by supplying a control signal to the first to third scan lines, the pixel circuits each include an input transistor, a drive transistor, a first switching transistor, a second switching transistor, a retention capacity, and a light-emitting device, the input transistor is turned on in response to the control signal provided by the first scan line in a predetermined sampling period, and samples a signal potential of the video signal provided by the signal lines to the retention capacity, the retention capacity applies an input voltage to a gate of the drive transistor in accordance with the signal potential of the sampled video signal, the drive transistor supplies an output current corresponding to the input voltage to the light-emitting device, the light-emitting device emits a light with an intensity corresponding to the signal potential of the video signal by the output current provided by the drive transistor during a predetermined light-emission period, the first switching transistor is turned on in response to the control signal provided by the second scan line before the sampling period, and sets the gate of the drive transistor to the first potential, the second switching transistor is turned on in response to the control signal provided by the third scan line before the sampling period, and sets a source of the drive transistor to the second potential, and the scanner section makes a timing setting to the control signal in such a manner that the first switching transistor is turned on before the second switching transistor.

5. The image display device according to claim 4, wherein the scanner section makes a timing setting to the control signal in such a manner that the second switching transistor is turned on with a lapse of a horizontal period after the first switching transistor is activated.

6. The image display device according to claim 5, wherein the scanner section includes a logic circuit for use in creating, from an output of a shift register for common use, the control signal for turning on the first switching transistor and the control signal for turning on the second switching transistor.

7. The image display device according to claim 4, wherein the scanner section includes: a shift register that outputs a serial signal with a phase difference of a horizontal period; a logic circuit that outputs a pair of intermediate signals of the same phase by processing the serial signal; and a delay circuit that outputs one of the intermediate signals as the control signal for use as it is in turning on the first switching transistor, and outputs the other intermediate signal as the control signal for use in turning on the second switching transistor after a delay process.

8. The image display device according to claim 4, wherein the scanner section includes:

a shift register that outputs a serial signal with a phase difference of a horizontal period;

a logic circuit that outputs a pair of intermediate signals of the same phase by processing the serial signal; and a mask circuit that outputs one of the intermediate signals as the control signal for use as it is to turn on the first switching transistor, and outputs the other intermediate signal as the control signal for use in turning on the second switching transistor after a mask process.

9. The image display device according to claim 4, wherein the scanner section includes:

a shift register that outputs a serial signal with a phase difference of a horizontal period;

a logic circuit that outputs a pair of intermediate signals of the same phase by processing the serial signal; and a buffer circuit that outputs one of the intermediate signals as the control signal for use in turning on the first switching transistor through a lesser number of buffers, and outputs the other intermediate signal as the control signal for use in turning on the second switching transistor through a larger number of buffers.

10. The image display device according to claim 4, wherein the pixel circuits each include a third switching transistor whose gate is connected to a fourth scan line, and the third switching transistor connects the drive transistor at a third potential by being turned on in response to a control signal provided by the fourth scan line before the sampling period to retain a voltage equivalent to a threshold voltage of the drive transistor at the retention capacity for correction of any influence of the threshold voltage, and connects the drive transistor at the third potential by being turned on in response to the control signal provided again by the fourth scan line during the light-emission period to flow the output current to the light-emitting device.

11. The image display device according to claim 10, wherein in the drive transistor, the output current has a dependence with respect to a carrier mobility of a channel area, and the third switching transistor connects the drive transistor to the third potential by being turned on during the sampling period, extracts the output current from the drive transistor while the signal potential is being sampled, corrects the input voltage with a negative feedback to the retention capacity, and cancels out the dependence of the output current with respect to the carrier mobility.

12. A drive method for an image display device in which a pixel array section, a scanner section, and a signal section are included, the pixel array section is configured by first to third scan lines disposed in a line, signal lines disposed in a row, matrix-shaped pixel circuits connected to the scan lines and the signal lines, and a plurality of power lines that supply first and second potentials needed for operation of the pixel circuits, the signal section supplies a video signal to the signal lines, the scanner section sequentially scans the pixel circuits, on a line basis, by supplying a control signal to the first to third scan lines, and the pixel circuits each include an input transistor, a drive transistor, a first switching transistor, a second switching transistor, a retention capacity, and a light-emitting device, comprising the steps of:

sampling, by the input transistor, a signal potential of the video signal provided by the signal lines to the retention capacity by being turned on in response to the control signal provided by the first scan line during a predetermined sampling period;

applying, by the retention capacity, an input voltage to a gate of the drive transistor in accordance with the signal potential of the sampled video signal;

supplying, by the drive transistor, an output current corresponding to the input voltage to the light-emitting device;

emitting a light, by the light-emitting device, with an intensity corresponding to the signal potential of the video signal by the output current provided by the drive transistor during a predetermined light-emission period;

setting, by the first switching transistor, the gate of the drive transistor to the first potential by being turned on in response to the control signal provided by the second scan line before the sampling period;

setting, by the second switching transistor, a source of the drive transistor to the second potential by being turned on in response to the control signal provided by the third scan line before the sampling period; and making a timing setting, by the scanner section, to the control signal in such a manner that the first switching transistor is turned on before the second switching transistor.

* * * * *